US012692061B2

(12) United States Patent
Melrose et al.

(10) Patent No.: US 12,692,061 B2
(45) Date of Patent: Jul. 28, 2026

(54) CONTAINER WITH DYNAMIC BASE

(71) Applicant: CO2Pac Limited, Auckland (NZ)

(72) Inventors: David M. Melrose, Auckland (NZ); Campbell Melrose-Allen, Auckland (NZ); Raymond A. Pritchett, Jr., Mt. Wolf, PA (US); Shannon K. Sprenkle, York, PA (US); David K. Dinius, Jr., York, PA (US); Robert L. Waltemyer, Jr., Felton, PA (US)

(73) Assignee: CO2Pac Limited, Auckland (NZ)

( * ) Notice: Subject to any disclaimer, the term of this patent is extended or adjusted under 35 U.S.C. 154(b) by 0 days.

(21) Appl. No.: 19/404,600

(22) Filed: Dec. 1, 2025

(65) Prior Publication Data

US 2026/0084882 A1 Mar. 26, 2026

Related U.S. Application Data

(63) Continuation of application No. 19/232,605, filed on Jun. 9, 2025.

(60) Provisional application No. 63/659,133, filed on Jun. 12, 2024.

(51) Int. Cl.

| | |
|---|---|
| ***B65D 1/46*** | (2006.01) |
| ***B65D 1/02*** | (2006.01) |
| ***B65D 79/00*** | (2006.01) |

(52) U.S. Cl.

CPC ..... *B65D 79/0081* (2020.05); *B65D 1/0246* (2013.01); *B65D 1/0284* (2013.01); *B65D 2501/0036* (2013.01)

(58) Field of Classification Search

CPC ..... B65D 79/0081; B65D 1/0246; B65D 1/0284; B65D 2501/0036; B65D 1/46; B65D 1/02

USPC ..... 220/609, 606; 215/375, 373

See application file for complete search history.

(56) References Cited

U.S. PATENT DOCUMENTS

2015/0136727 A1* 5/2015 Hermel ..... B65D 1/0284 215/373

* cited by examiner

*Primary Examiner* — Jeffrey R Allen
*Assistant Examiner* — Elizabeth J Volz
(74) *Attorney, Agent, or Firm* — Rothwell, Figg, Ernst & Manbeck, P.C.

(57) ABSTRACT

A plastic container comprising a container body comprising a bottom portion, an upper portion, a sidewall portion extending between the upper portion and the bottom portion, and a finish portion. The container body having a chamber defined therein. The finish portion extends from the upper portion and defines a mouth in fluid communication with the chamber. The bottom portion including a base portion comprising (i) a support surface, (ii) a plurality of ribs, (iii) a plurality of voids, and (iv) an inner core aligned with a central axis of the container body. The inner core including a contoured wall portion, a first radiused wall portion adjacent the contoured wall portion, and a second radiused wall portion adjacent the first radiused wall portion. The bottom portion is configured to permit a region of said base portion to move in response to a pressure differential.

20 Claims, 25 Drawing Sheets

CONTAINER WITH DYNAMIC BASE

CROSS-REFERENCE TO RELATED APPLICATIONS

This application is a continuation of U.S. patent application Ser. No. 19/232,605, filed Jun. 9, 2025, which claims priority to U.S. Provisional Patent Application No. 63/659,133, filed Jun. 12, 2024, the contents of which are incorporated herein by reference in their entireties.

TECHNICAL FIELD

The presently disclosed subject matter relates generally to plastic containers, for example a blow-molded bottle with an active base.

BACKGROUND

The disclosed subject matter relates to containers (e.g., plastic containers such as bottles) having physical features and characteristics to better sustain and accommodate hot-filling and other common manufacturing processes such as blow processes, including the corresponding forces and/or other thermal/pressure scenarios that the container is exposed to during such processes. For example, during the processes of hot-filling, sealing, and cooling, containers are subject to different thermal and pressure scenarios (e.g., positive and negative (e.g., internal) pressures, other pressure differential scenarios, and/or vacuum) that can cause deformation, which may render the containers visually unappealing or non-functional. Because of these issues, aspects such as the shape and surface geometry that define the container's appearance, along with a desire to make the container lighter (such as by reducing the amount of material used) while maintaining functional strength, must be considered.

Conventional containers include physical and/or other functional features intended to account for these issues, including vacuum panels and/or bases designed to accommodate different thermal and pressure scenarios. These features help control, reduce, or eliminate unwanted events such as deformation, which in turn may improve the visual appeal and other functional aspects of the container for other downstream situations. However, despite such physical/functional features, problems persist with respect to sufficiently accommodating deformation, as well as container strength, weight, and look and feel. These limitations may also negatively impact other aspects such as the weight, structural integrity thereby hindering the ability to make the container lighter while maintaining an equivalent or improved level of functionality and performance through the entire fill and distribution process.

For example, in existing bottles that include voids in the base which extend to the side wall, the base can deform to become 'out of round' which can cause bottle handling and packing problems. In these existing bottles, after the bottle is filled, sealed and cooled, the diameter of the bottom of the bottle can include 'points' or protrusions at locations where the voids extend to the side wall. These 'points' extend beyond the major diameter of the bottle, form a non-round shape and can become touch points as the bottle is handled on the filling line and packed into cartons or cases. The non-round shape can cause the bottle to jam or hang up when moving along the production line. Proper packing of cartons and cases require the bottles to remain within their major diameter to fit properly in the case. The 'points' or protrusions and the resulting non-round shape can cause the bottle to not be properly packed into the cartons and cases.

Thus, there is a need for a plastic container that is visually appealing, resists, or provides compensation against, distortion under hot-filling and other processes and allows for the container to be lighter in weight while maintaining (or even improving) a sufficient level of functional strength. Such a container should be capable of accommodating negative pressures relative to the atmosphere due to such cooling, positive pressures due to changes in altitude or the like, internal pressure exerted during the hot-fill and capping process, other vacuum scenarios, as well as flexing to retain overall bottle integrity and shape during and after the cooling process.

SUMMARY

The purpose and advantages of the disclosed subject matter will be set forth herein and will be apparent from the description that follows, as well as will be learned by practice of the disclosed subject matter. Additional advantages of the disclosed subject matter will be realized and attained by the subject matter particularly pointed out in the written description and claims hereof, as well as from the appended drawings.

To achieve these and other advantages and in accordance with the purpose of the disclosed subject matter, as embodied and broadly described, the disclosed subject matter includes a plastic container comprising a container body. The container body comprising a bottom portion, an upper portion, a sidewall portion extending between the upper portion and the bottom portion, and a finish portion. The container body having a chamber defined therein and the finish portion extends from the upper portion and defines a mouth in fluid communication with the chamber. The bottom portion including a base portion comprising (i) a support surface, (ii) a plurality of ribs, (iii) a plurality of voids, and (iv) an inner core aligned with a central axis of the container body. The inner core including a contoured wall portion, a first radiused wall portion adjacent the contoured wall portion, and a second radiused wall portion adjacent the first radiused wall portion. The plurality of ribs and the plurality of voids are arranged radially relative to the inner core. The bottom portion is configured to permit a region of the base portion to move in response to a pressure differential.

In accordance with another aspect of the disclosed subject matter, a plastic container comprises a container body. The container body comprising a bottom portion, an upper portion, a sidewall portion extending between the upper portion and the bottom portion, and a finish portion. The container body having a chamber defined therein and the finish portion extending from said upper portion and defining a mouth in fluid communication with the chamber. The bottom portion including a base portion comprising (i) a support surface, (ii) a plurality of ribs, (iii) a plurality of voids, and (iv) an inner core aligned with a central axis of the container body. The inner core including a contoured wall portion, a first radiused wall portion, and a second radiused wall portion adjacent the first radiused wall portion. The base portion further comprising a hinge point, and the second radiused wall portion having an angled configuration adjacent the hinge point. The plurality of ribs and the plurality of voids are arranged radially relative to the inner core. The bottom portion is configured to permit a region of base portion to move in response to a pressure differential.

BRIEF DESCRIPTION OF THE DRAWINGS

The subject matter of the application will be more readily understood from the following detailed description when read in conjunction with the accompanying drawings, in which.

DETAILED DESCRIPTION

Figure 1:
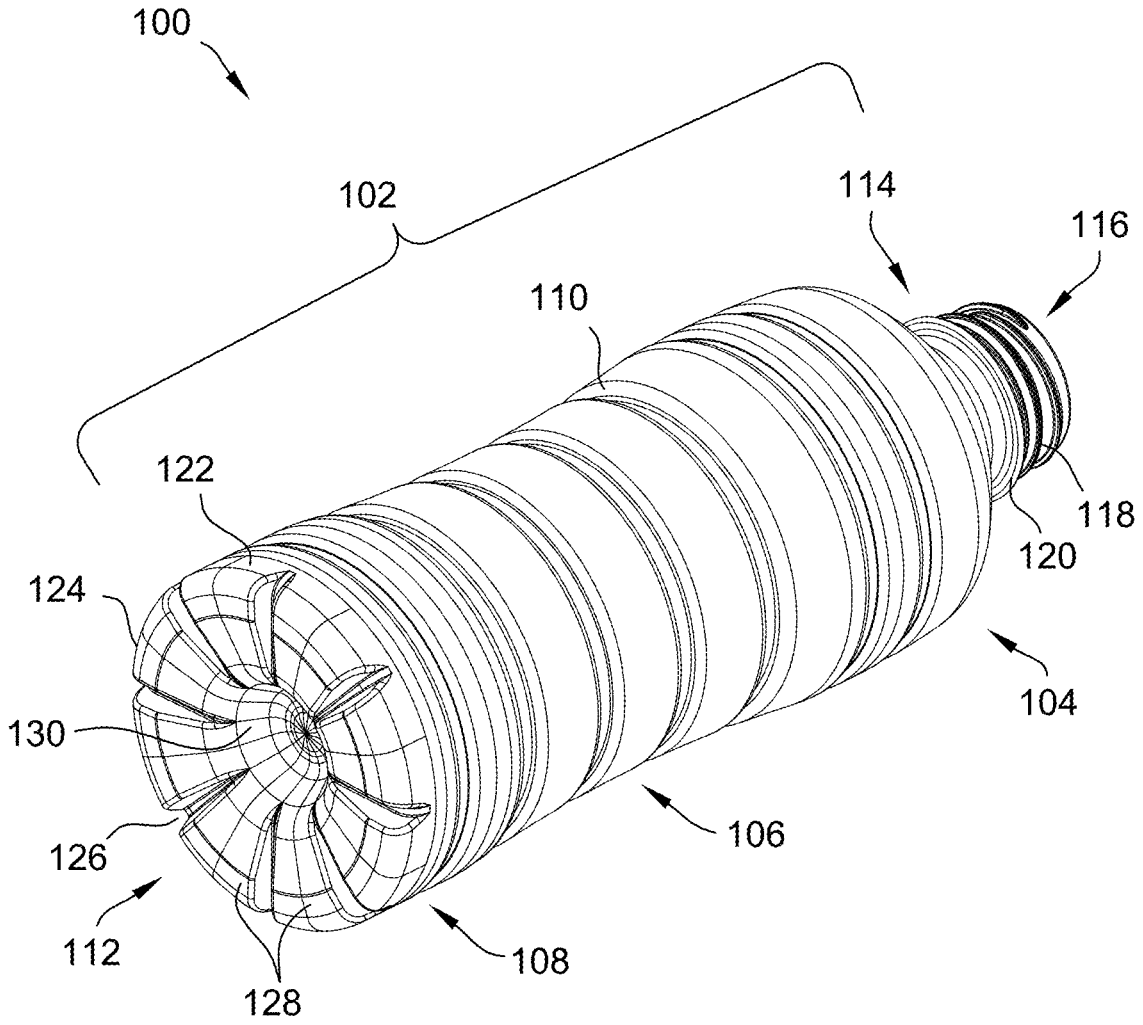
FIG. 1 is a perspective view of an exemplary embodiment of a container according to the disclosed subject matter.

In the following specification and the claims, reference will be made to a number of terms, which shall be defined to have the following meanings.

As used herein, the singular forms "a," "an," and "the" include plural references unless the context clearly dictates otherwise. The terms "comprising," "including," and "having" are intended to be inclusive and mean that there may be additional elements other than the listed elements. The terms "optional" or "optionally" means that the subsequently described event or circumstance may or may not occur, and that the description includes instances where the event occurs and instances where it does not.

Unless otherwise indicated, approximating language, such as generally, "substantially," and "about," as used herein indicates that the term so modified may apply to only an approximate degree, as would be recognized by one of ordinary skill in the art, rather than to an absolute or perfect degree. Accordingly, a value modified by a term or terms, such as "about," "approximately," and "substantially," is not to be limited to the precise value specified. In at least some instances, the approximating language may correspond to the precision of an instrument for measuring the value. Here and throughout the specification and claims, range limitations may be identified. Such ranges may be combined and/or interchanged and include all the sub-ranges contained therein unless context or language indicates otherwise.

Additionally, unless otherwise indicated, the terms "first," "second," etc. are used herein merely as labels, and are not intended to impose ordinal, positional, or hierarchical requirements on the items to which these terms refer. Moreover, reference to, for example, a "second" item does not require or preclude the existence of, for example, a "first" or lower-numbered item or a "third" or higher-numbered item.

As used herein, the term "preform" refers to a plastic, thermoplastic or polyethylene terephthalate "PET" plastic preform (or other materials disclosed herein) for use in injection molding and blow molding applications. The preform commonly includes an injection molded body having a threaded end, a lip adjacent to the threaded end, a neck adjacent to the lip, and a cylindrical or conical body adjacent to the neck. Gripping or transfer devices of a manufacturing line for injection molding and blow molding applications commonly interface with the lip and/or the neck of the preform to transfer or secure the preform.

The apparatus and methods presented herein may be used for containers, such as plastic containers for fluids. The containers disclosed herein can be used in filling applications for packaging a wide variety of beverage or liquid products, such as juices, sauces, teas, flavored waters, nectars, isotonic drinks, and sports drinks, etc. More specifically, the filling application includes hot-filling of plastic containers. The plastic containers described herein are configured to accommodate an increase in internal container pressure differential when the sealed containers are subject to thermal treatment and are capable of accommodating vacuum during cool down. The unique configuration of the disclosed plastic containers incorporates a number of features that collectively control unwanted deformation during hot-filling processes. Furthermore, the plastic containers disclosed herein have unique (e.g., asymmetrical or symmetrical) designs for the hot-fill beverage market.

The containers and portions thereof described herein can be formed from materials including, but not limited to, polyethylene terephthalate (PET), polyethylene naphthalate (PEN) and PEN-blends, polypropylene (PP), high-density polyethylene (HDPE). The disclosed subject matter is particularly suited for hot-fillable containers having a base design that is reactive to internal and external pressure due to pressure filling and/or due to thermal expansion from hot filling to provide controlled deformation that preserves the structure, shape, and functionality of the container. The base portion of the container can also provide substantially uniform controlled deformation when vacuum pressure is applied, for example due to product contraction from product cooling. For example, the container experiences stress or strain at low pressure differential, and distortion of the container occurs as the pressure differential increases, such as when vacuum increases during cooling. The configuration of the disclosed plastic containers incorporates a number of features that collectively control unwanted deformation during hot-filling processes.

In accordance with the disclosed subject matter, a plastic container for hot-filling processes is provided. The plastic container generally comprises a container body having a bottom portion, an upper portion and a sidewall portion extending between the bottom portion and the upper portion. The container body further comprises a finish portion extending from the upper portion and defining a mouth in fluid communication with a chamber defined by the container body. The bottom portion further comprises a base portion. These various portions are designed and configured with certain features having certain characteristics, dimensions, and arrangements. For example, and without limitation, the sidewall portion may include at least one circumferential indent. The base portion may include a plurality of features such as ribs and voids, and an inner core comprising walls and other portions that provide the inner core with a certain design. By way of the design, dimensions, and arrangement of these various features, the container can accommodate certain forces it experiences. For example, the base portion is configured as a variable dynamic base portion and can deflect in response to various forces, such as a pressure differential between the chamber and an exterior of the container body, thereby providing structural integrity to the container, and preserving a desired look and feel of the container for product retail purposes.

Reference will now be made in detail to embodiments of the disclosed subject matter, an example of which is illustrated in the accompanying drawings. The accompanying figures, where like reference numerals refer to identical or functionally similar elements throughout the separate views, serve to further illustrate various embodiments and to explain various principles and advantages all in accordance with the disclosed subject matter. Hence, features depicted in the accompanying figures support corresponding features and combinations thereof of the claimed subject matter. The disclosed subject matter will be described in conjunction with the detailed description of the system.

Referring now to an exemplary embodiment as depicted in FIG. 1, for purpose of illustration and not limitation, a container 100 (e.g., a hot-fillable plastic container, more specifically a hot-fillable plastic bottle) comprises a container body 102 having an upper portion 104, a sidewall portion 106, and a bottom portion 108. Upper portion 104 includes a radiused wall portion having a certain slope or other angle or contour (better viewable in FIGS. 3 and 4). Sidewall portion 106 includes at least one circumferential indent 110 and is located between upper portion 104 and bottom portion 108. Bottom portion 108 includes a base portion 112. In one embodiment, indents 110 are located in sidewall portion 106. In another embodiment, indents 110 are located in other portions (e.g., the upper and bottom portions 104 and 108) of container 100. Indents 110 function primarily as circumferential, structural ribs to add structural integrity to container 100. Container body 102 defines a chamber (not shown) therein for containing fluids (e.g., liquid product such as waters, sports drinks, alcoholic beverages) and/or foods (e.g., apple sauce). Additionally, container body 102 includes a finish portion 114 extending from upper portion 104 and defining a mouth 116 in fluid communication with the chamber. Finish portion 114 can have a variety of configurations, and in the exemplary embodiment, includes a fastener or other engagement mechanism such as a thread 118 and flange 120. Thread 118 and/or flange 120 is for engaging a cap (not shown) or other closure member (not shown) of the container. These elements have an orientation and capping features as known in the art.

In the exemplary embodiment, sidewall portion 106 is formed with circumferential indents 110, which can also be referred to as grooves, rings, ribs, or beads. As shown in FIG. 1, a plurality of indents 110 extend about an entire circumference of container 100, such circumference being relative to a particular diameter of any given section of container 100 where indents 110 are to be located. In the exemplary embodiment, a shape and width of container 100 varies from bottom to top as shown in FIG. 1.

As illustrated in the exemplary embodiment, and as shown in FIG. 1, bottom portion 108 includes base portion 112 comprising a cylindrical base wall portion 122, a plurality of ribs, or feet, 124, a plurality of voids, or straps, 126, a support surface 128 defining a reference plane 142 (shown in FIG. 5), and an inner core 130. Each rib 124 includes a bottom surface portion 132 (shown in FIG. 3) which, in the exemplary embodiment, is substantially flat. Support surface 128 is comprised of bottom surface portions 132 of plurality of ribs 124. The combination of features 122, 124, 126, 128 and 130 and their respective structural/physical configurations enable base portion 112 to function as a variable dynamic base portion capable of moving in response to certain forces (e.g., pressure).

Figure 2A:
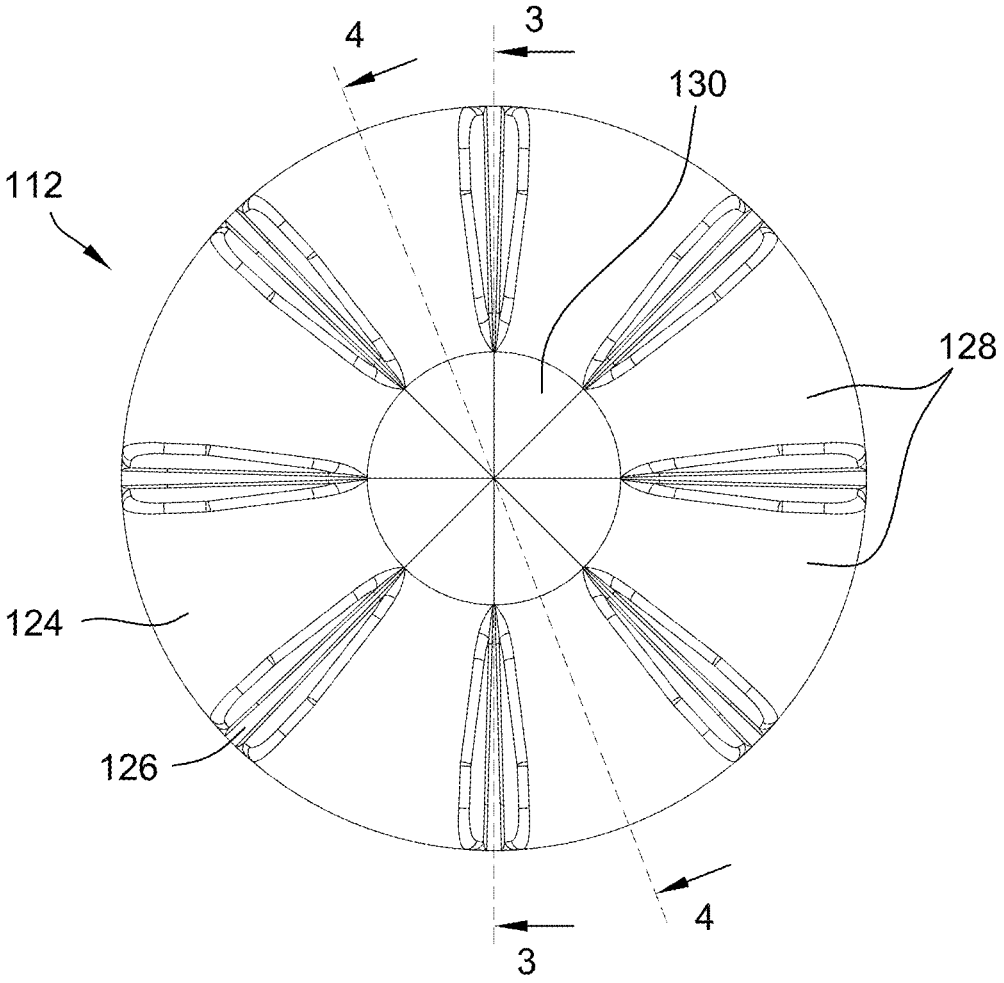
FIG. 2A is a bottom view of the container of FIG. 1.
Figure 2B:
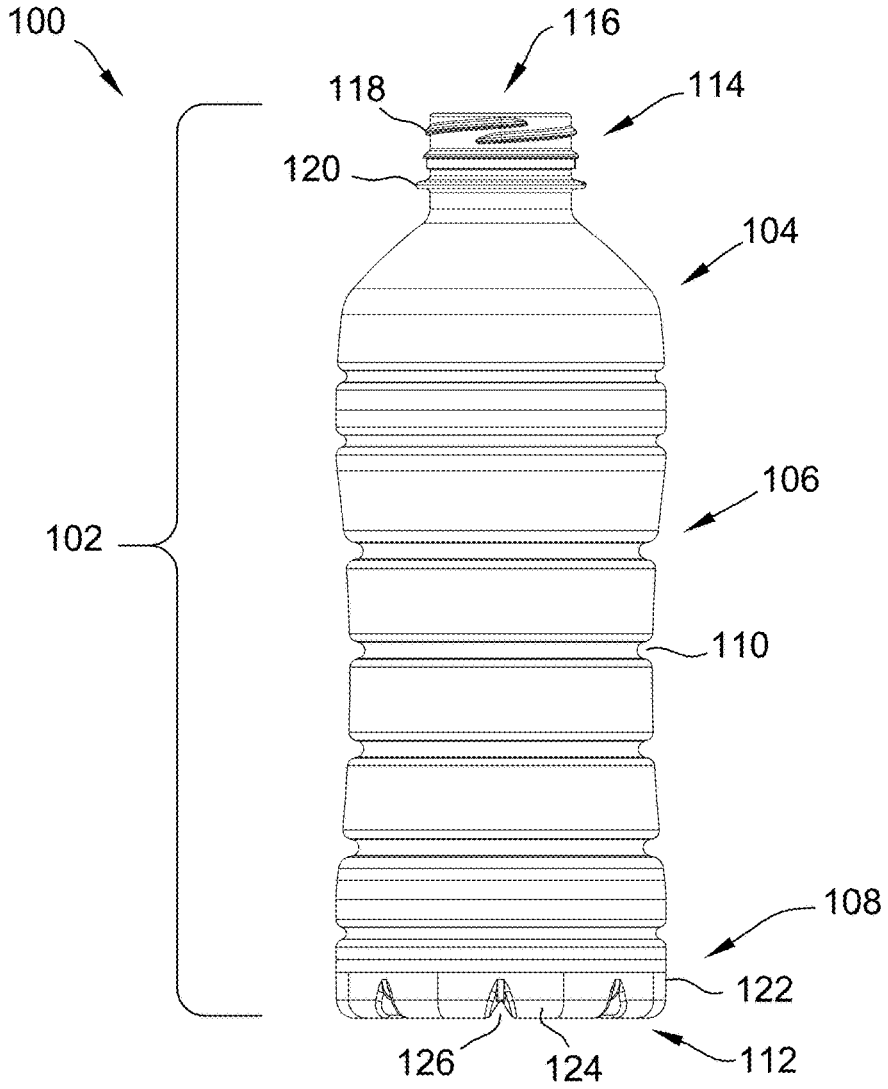
FIG. 2B is a front view of another embodiment of the container as disclosed herein.
Figure 2C:
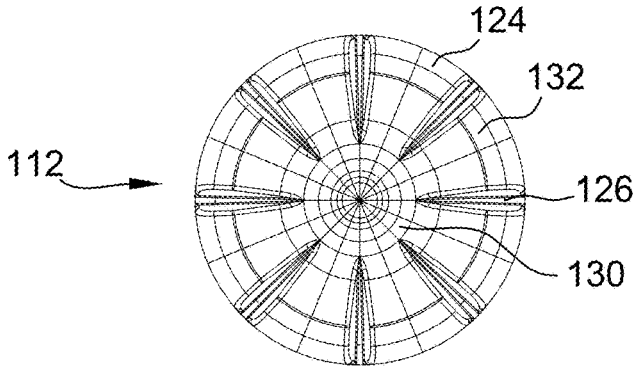
FIG. 2C is a bottom view of the container of FIG. 2B.
Figure 2D:
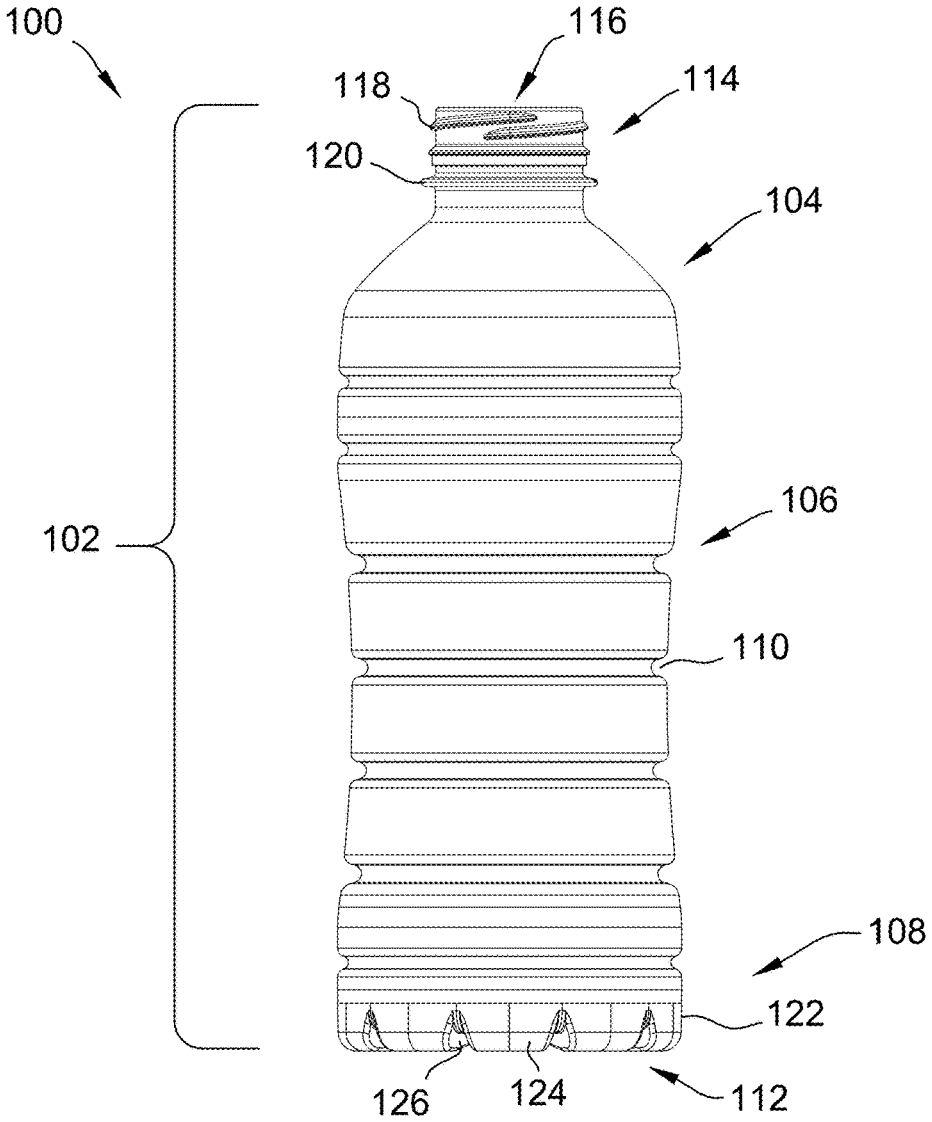
FIG. 2D is a front view of another embodiment of the container as disclosed herein.
Figure 2E:
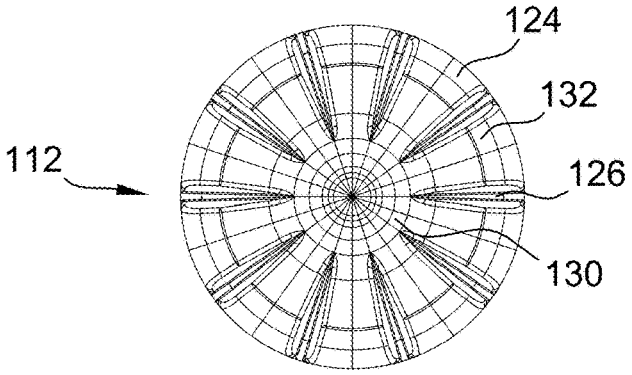
FIG. 2E is a bottom view of the container of FIG. 2D.
Figure 2F:
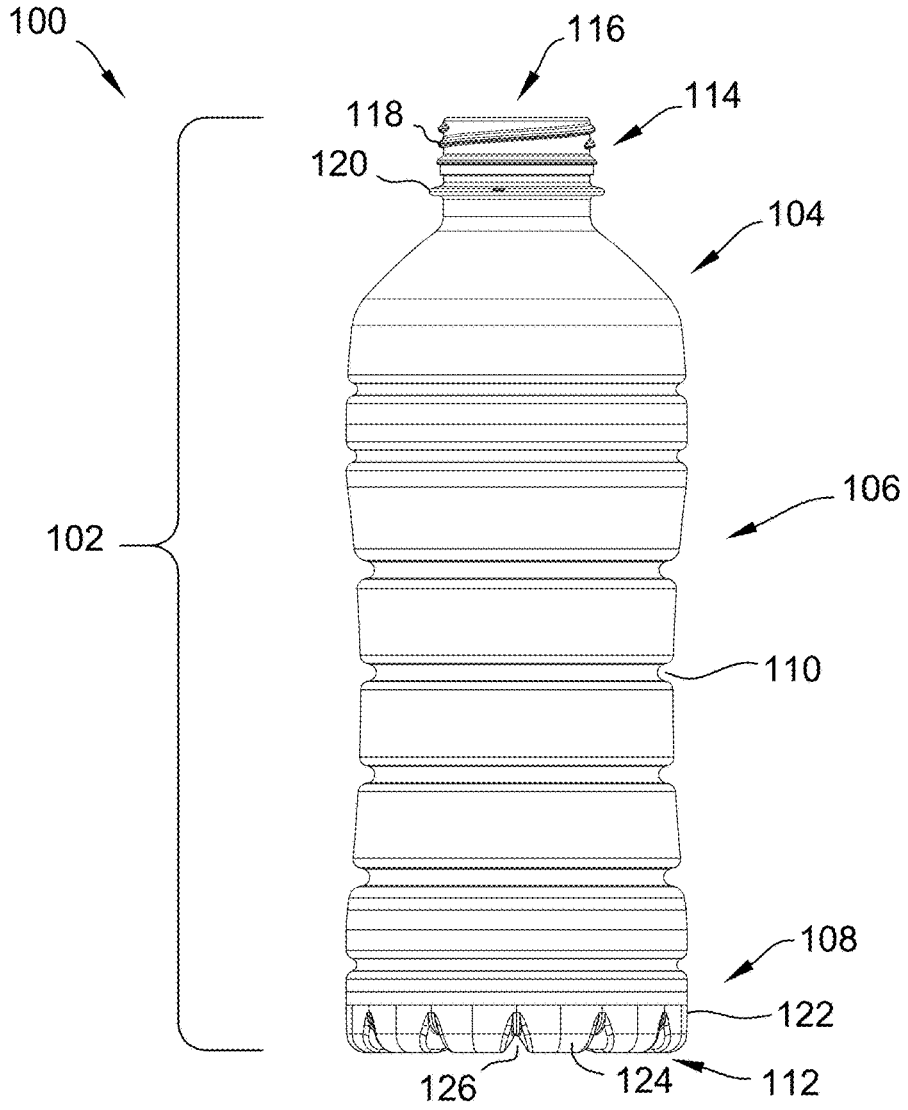
FIG. 2F is a front view of another embodiment of the container as disclosed herein.
Figure 2G:
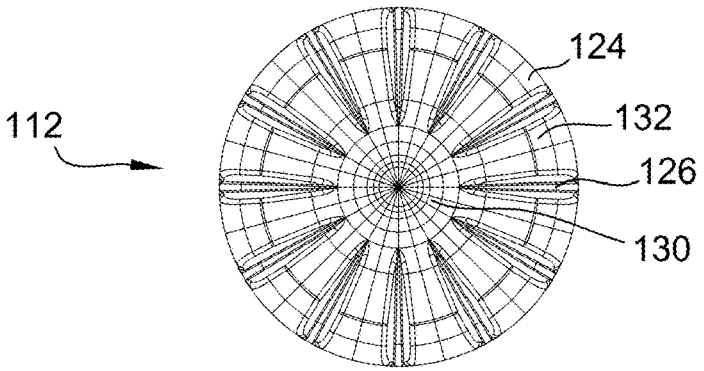
FIG. 2G is a bottom view of the container of FIG. 2F.
Figure 2H:
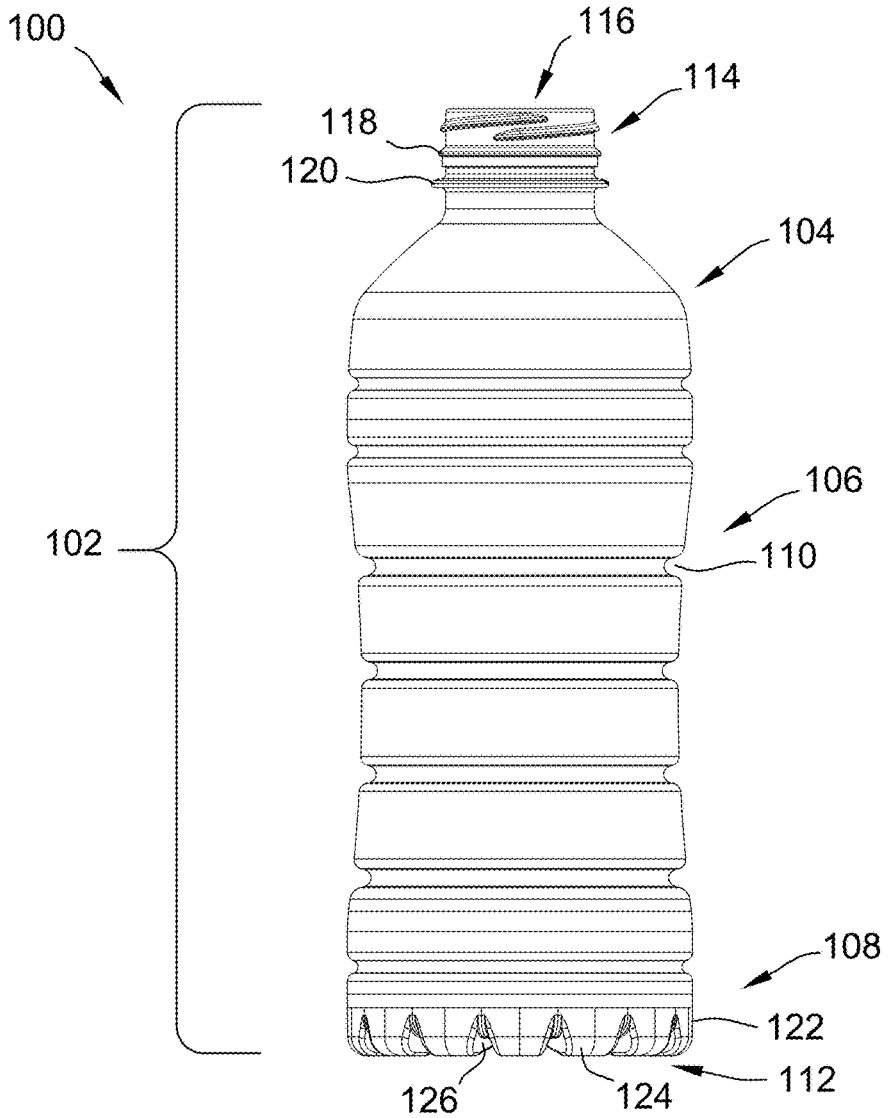
FIG. 2H is a front view of another embodiment of the container as disclosed herein.
Figure 2I:
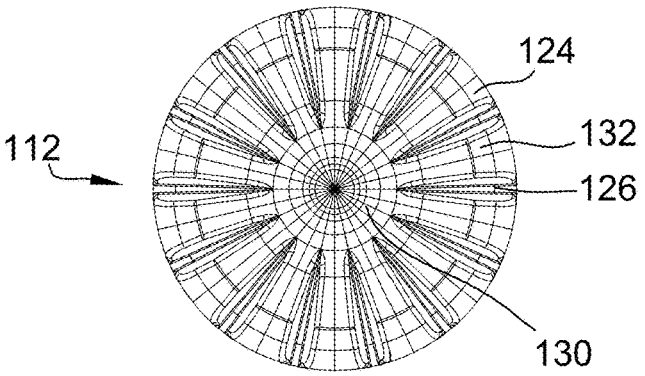
FIG. 2I is a bottom view of the container of FIG. 2H.
Figure 2J:
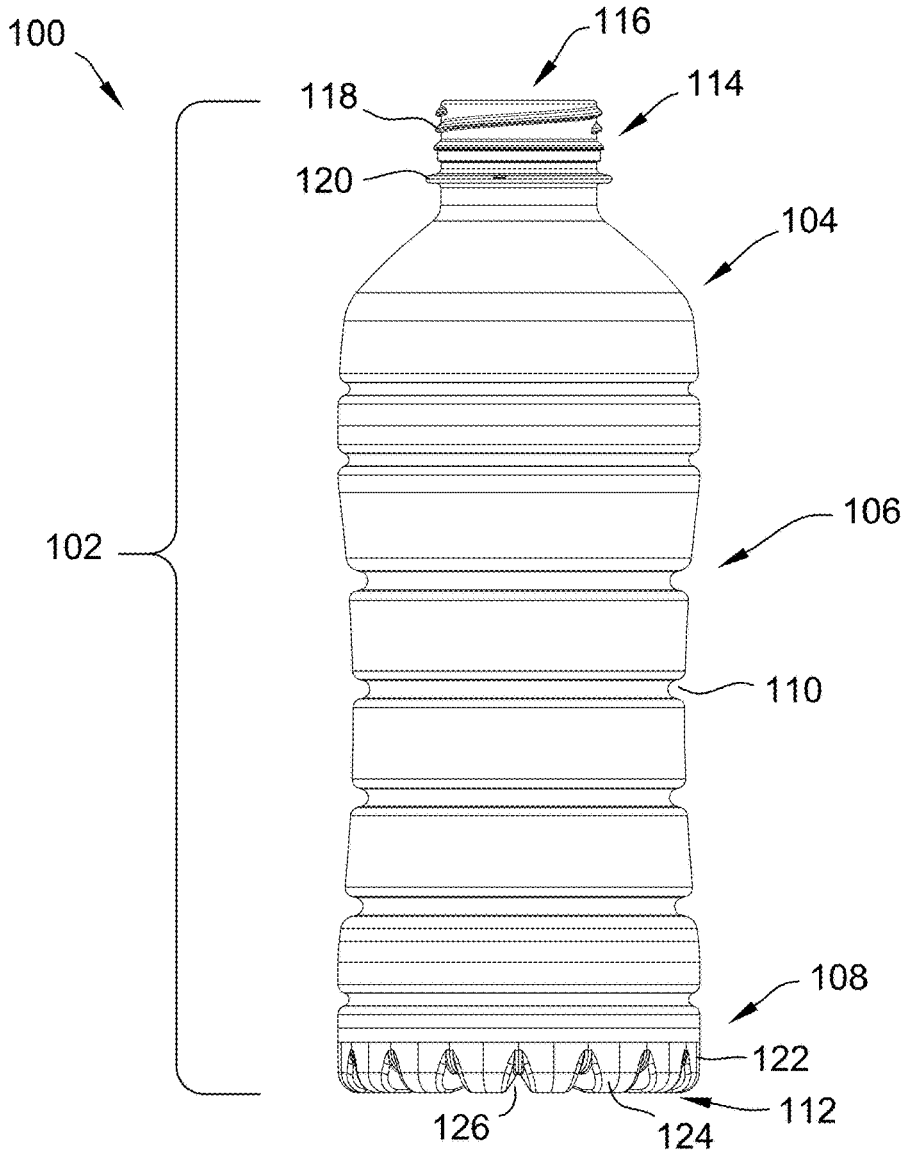
FIG. 2J is a front view of another embodiment of the container as disclosed herein.
Figure 2K:
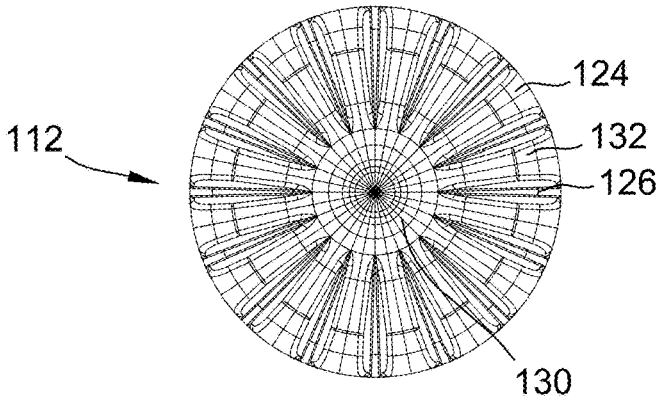
FIG. 2K is a bottom view of the container of FIG. 2J.
Figure 2L:
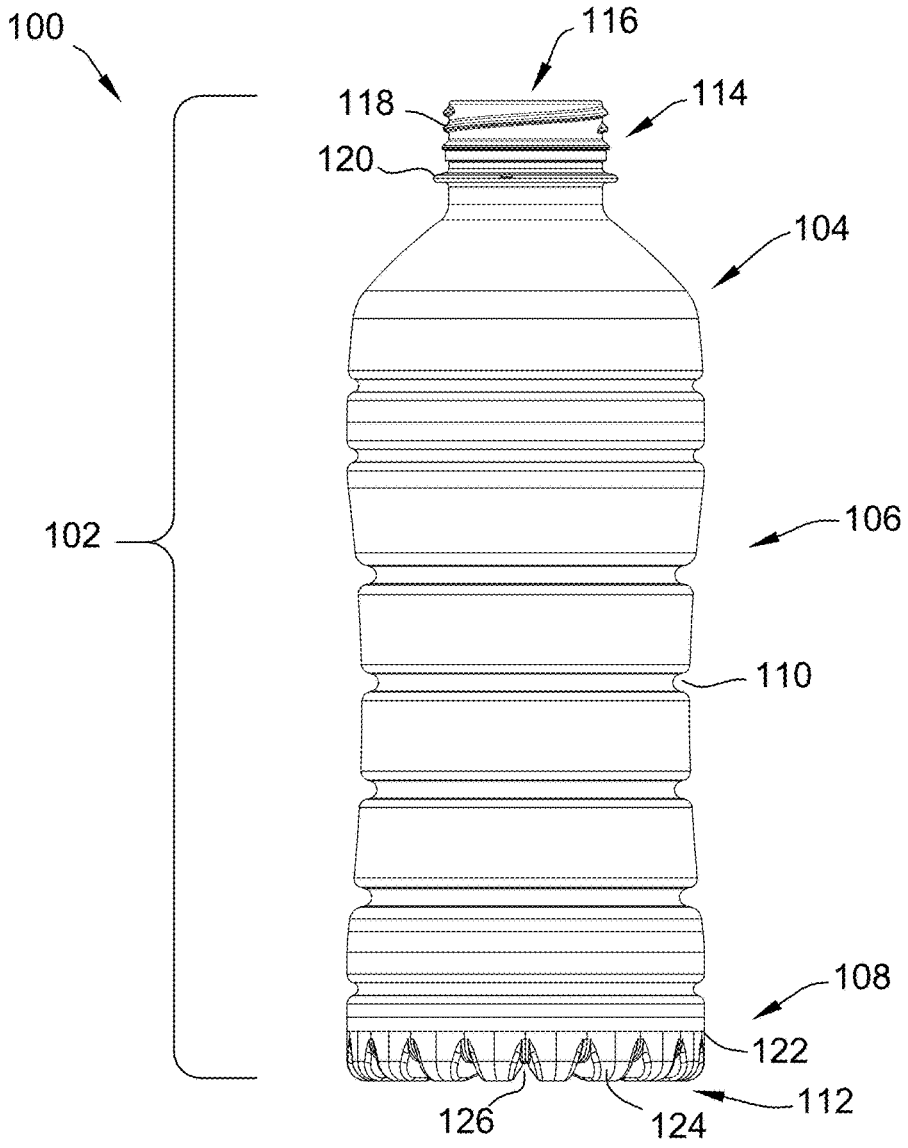
FIG. 2L is a front view of another embodiment of the container as disclosed herein.
Figure 2M:
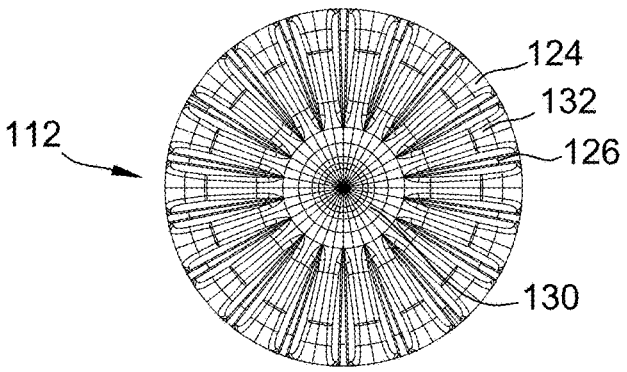
FIG. 2M is a bottom view of the container of FIG. 2L.
Figure 2N:
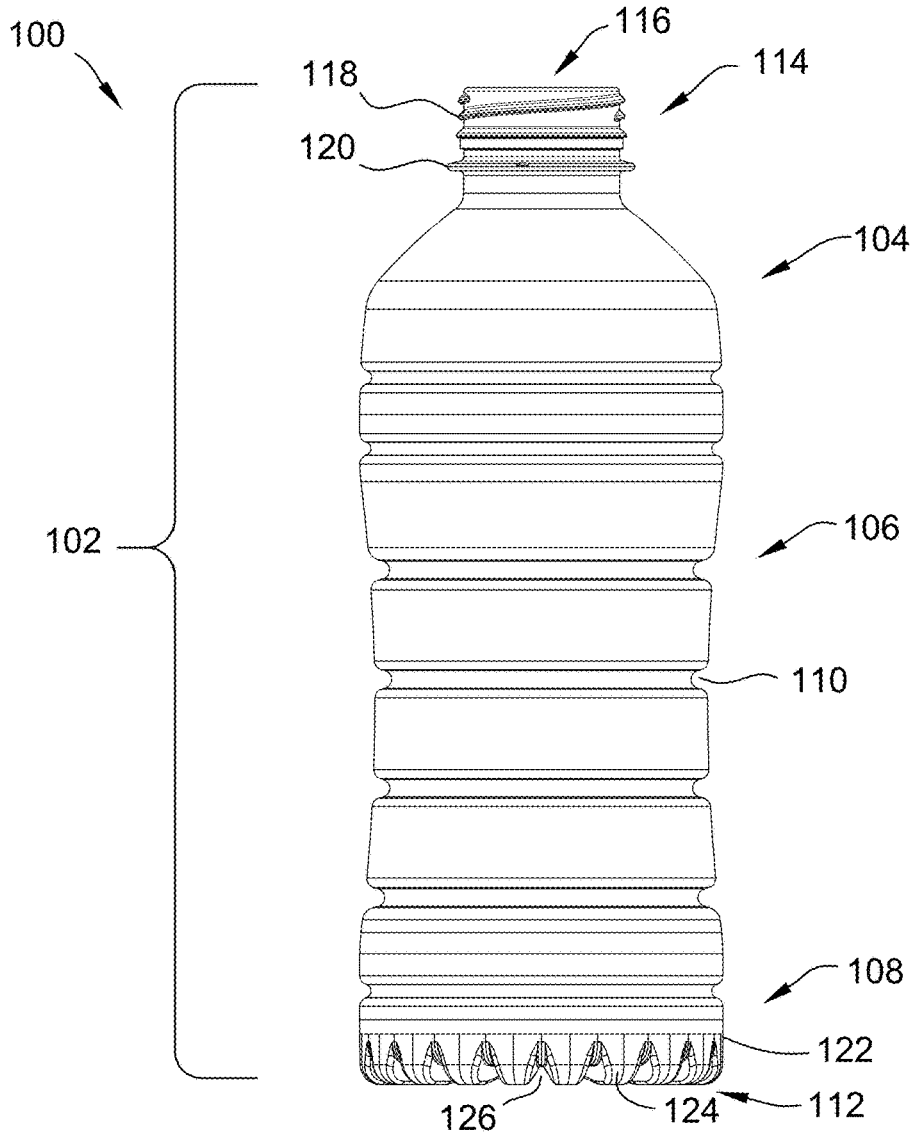
FIG. 2N is a front view of another embodiment of the container as disclosed herein.
Figure 2O:
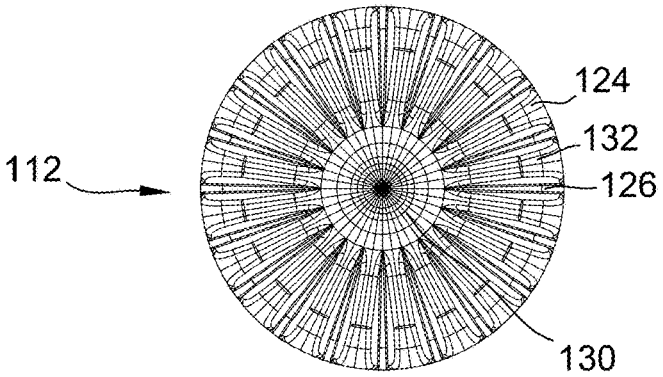
FIG. 2O is a bottom view of the container of FIG. 2N.
Figure 2P:
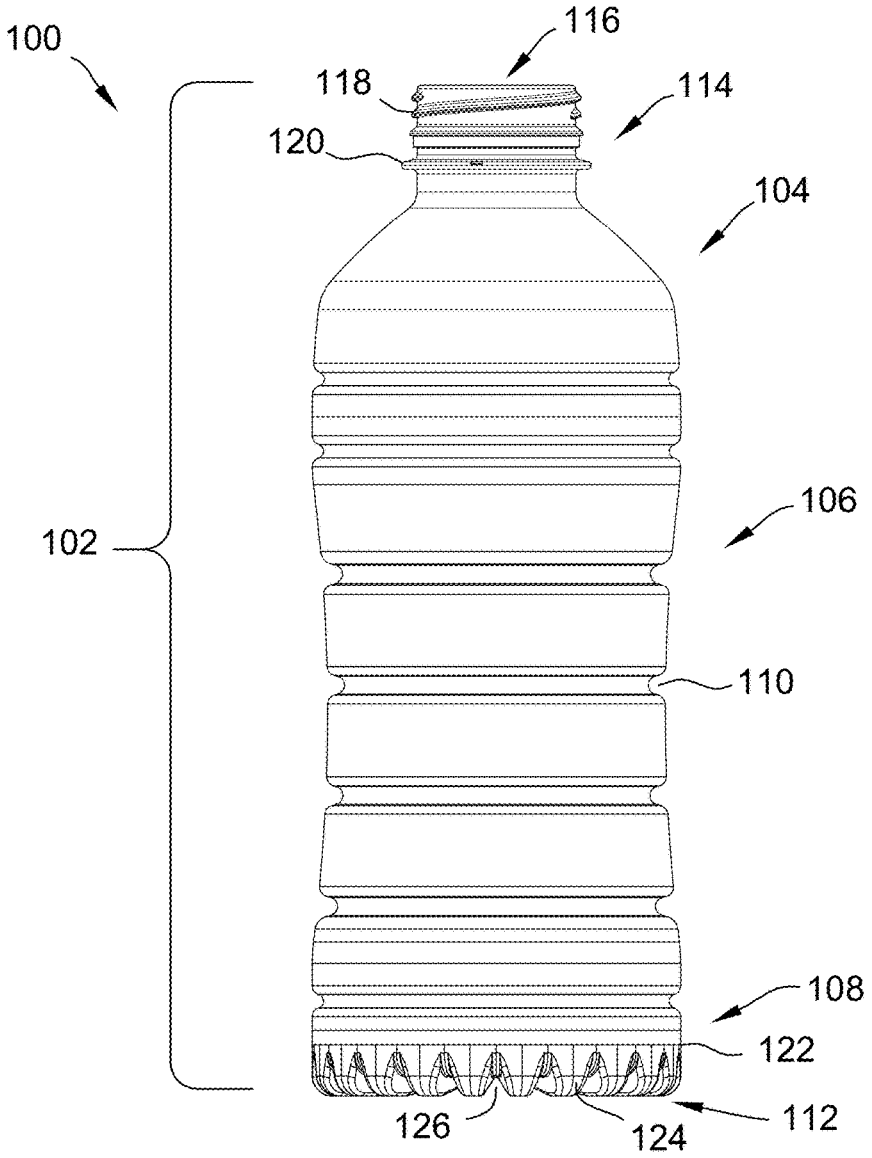
FIG. 2P is a front view of another embodiment of the container as disclosed herein.
Figure 2Q:
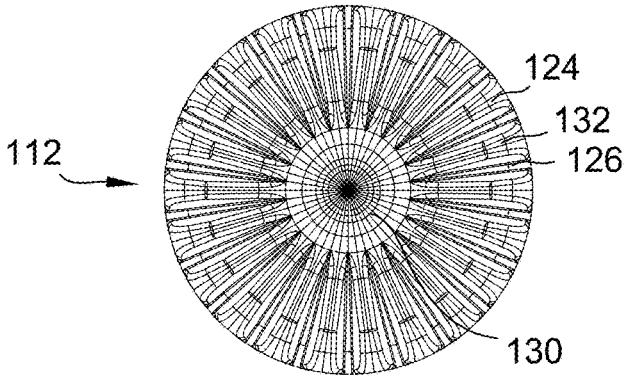
FIG. 2Q is a bottom view of the container of FIG. 2P.
Figure 2R:
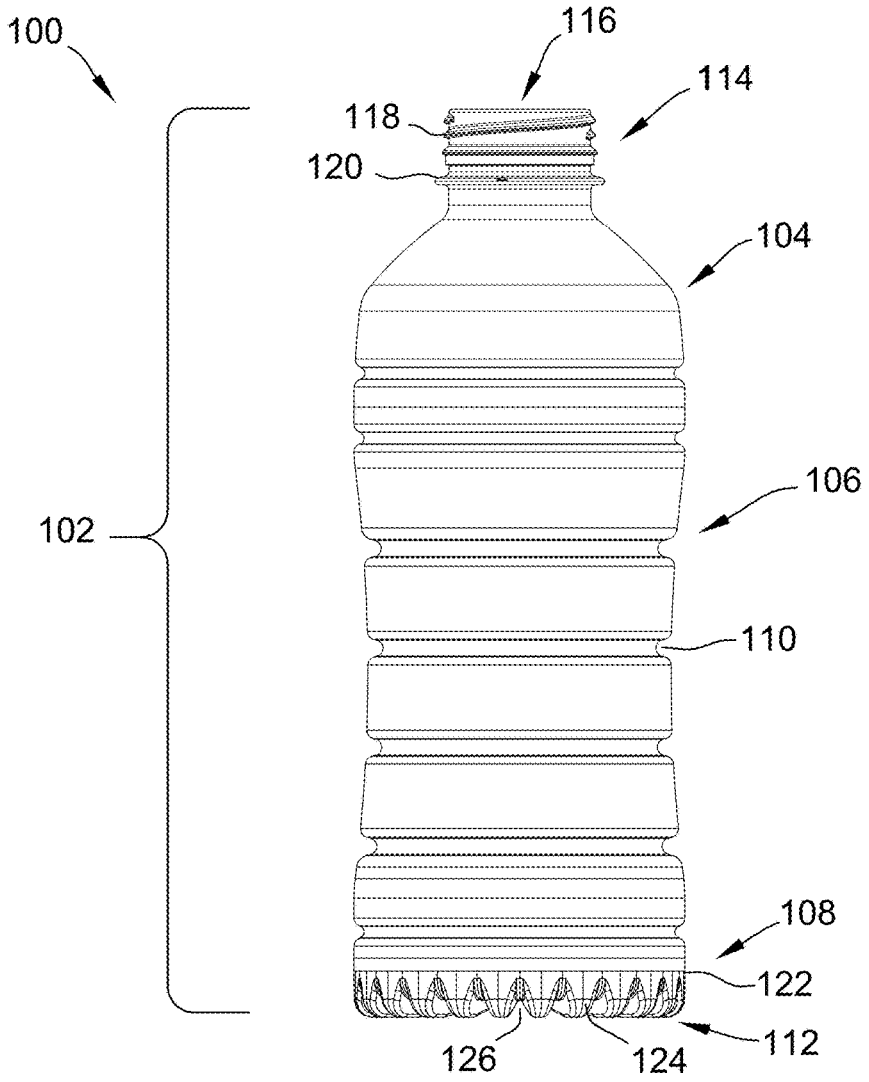
FIG. 2R is a front view of another embodiment of the container as disclosed herein.
Figure 2S:
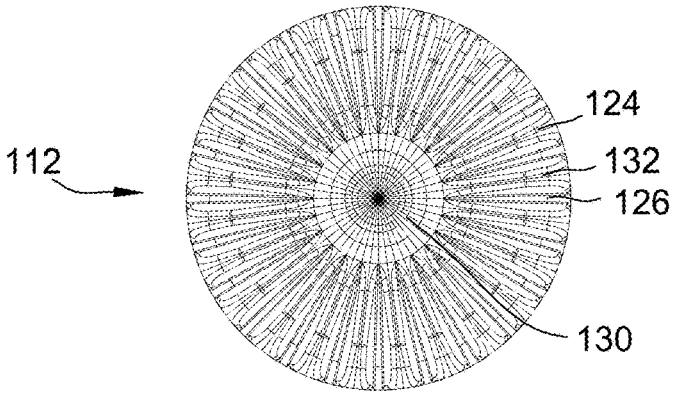
FIG. 2S is a bottom view of the container of FIG. 2R.

As illustrated in FIG. 2A, plurality of ribs 124 and plurality of voids 126 of base portion 112 are arranged in a radial configuration around inner core 130. A variety of suitable configurations can be used for ribs 124 and voids 126 in accordance with the disclosed subject matter. For example, base portion 112 may be configured to include a variety of rib 124/void 126 combinations, as illustrated in FIGS. 2B-2S. In the exemplary embodiment, base portion 112 is configured with 16 ribs 124 (and likewise 16 voids 126), as illustrated in FIGS. 2J and 2K. In an alternative embodiment, base portion 112 is configured with 20 ribs 124 and 20 voids 126, as illustrated in FIGS. 2N and 2O. In further alternative embodiments, base portion 112 is configured with: 8 ribs 124 (and likewise 8 voids 126) as illustrated in FIGS. 2B and 2C; 10 ribs 124 (and likewise 10 voids 126) as illustrated in FIGS. 2D and 2E; 12 ribs 124 (and likewise 12 voids 126) as illustrated in FIGS. 2F and 2G, 14 ribs 124 (and likewise 14 voids 126) as illustrated in FIGS. 2H and 2I, 18 ribs 124 (and likewise 18 voids 126) as illustrated in FIGS. 2L and 2M, 22 ribs 124 (and likewise 22 voids 126) as illustrated in FIGS. 2P and 2Q, or 24 ribs 124 (and likewise 24 voids 126) as illustrated in FIGS. 2R and 2S.

Figure 3:
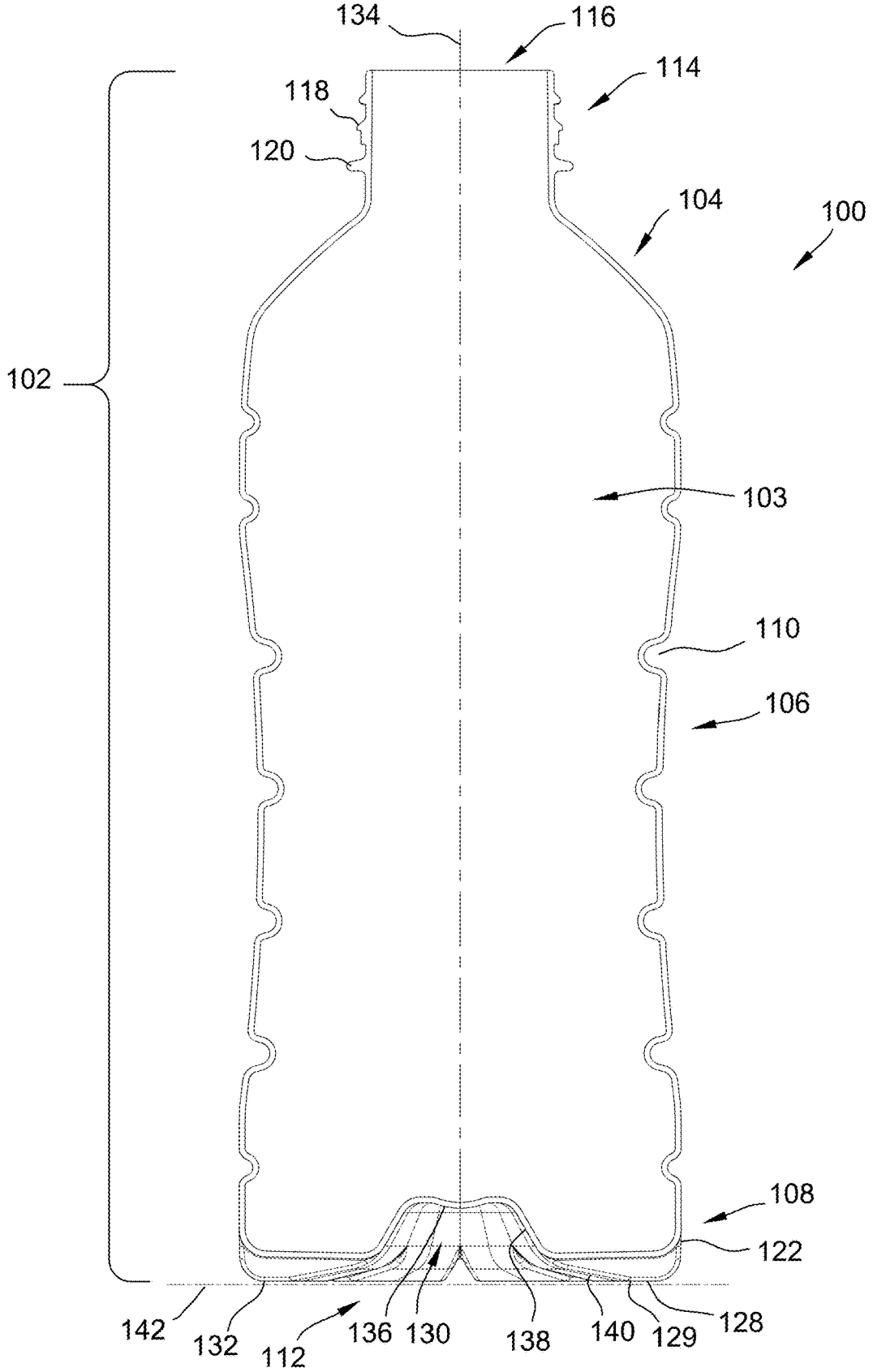
FIG. 3 is a cross-sectional view of the container of FIG. 1 taken along the line 3-3 of FIG. 2A.
Figure 4:
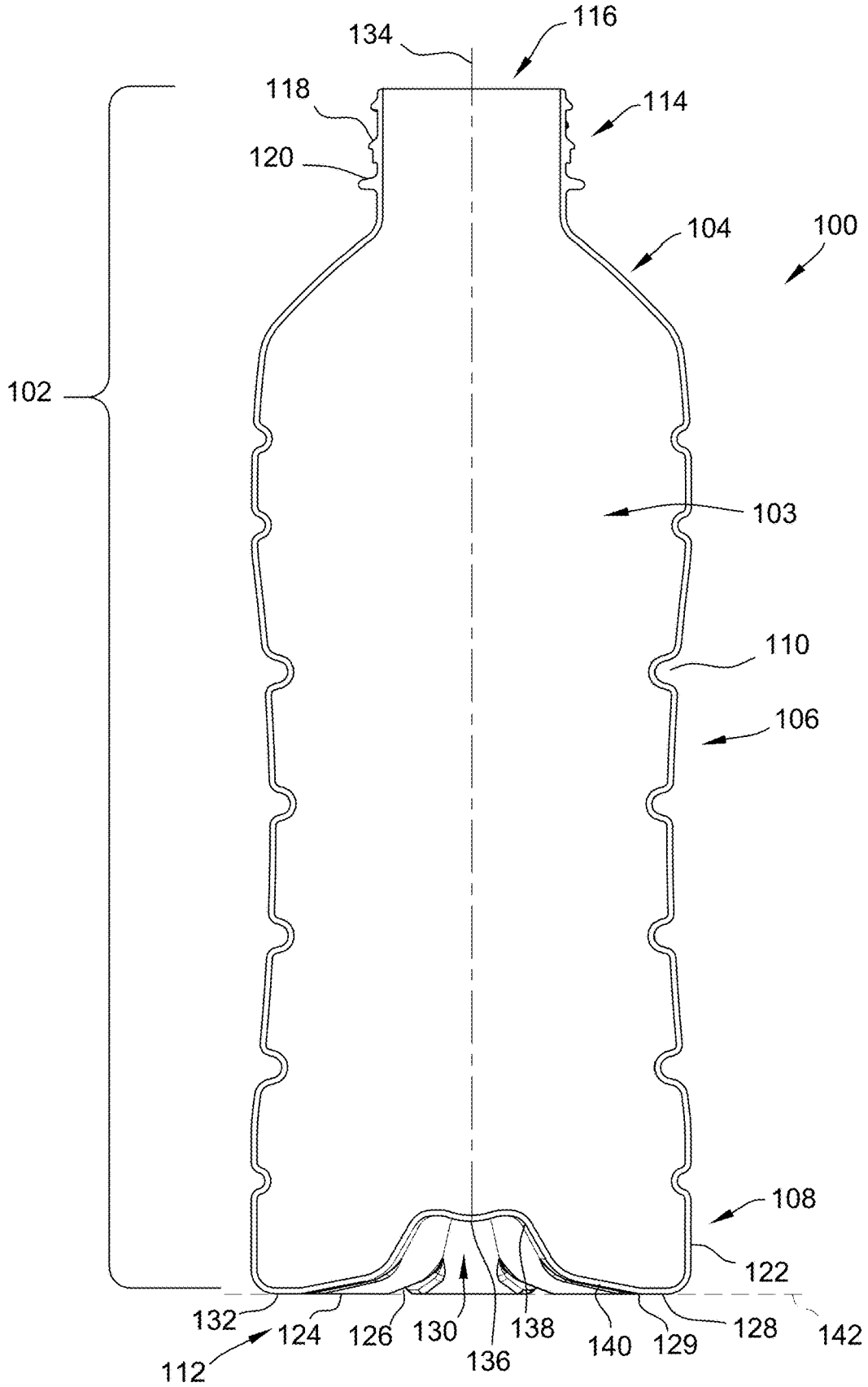
FIG. 4 is a cross-sectional view of the container of FIG. 1 taken along the line 4-4 of FIG. 2A.

FIGS. 3 and 4 illustrate cross sectional views of container 100 along lines 3-3 and 4-4, respectively of FIG. 2A. FIG. 3 illustrates a cross section through voids 126 of bottom portion 108 and FIG. 4 illustrates a cross section through ribs 124 of bottom portion 108. As illustrated in FIGS. 3 and 4, bottom portion 108 includes inner core 130 which is centrally located along a central longitudinal axis 134 of container body 102. Inner core 130 is defined by a central contoured wall portion 136 and adjacent radiused wall portions 138 and 140, more specifically first radiused wall portion 138 and second radiused wall portion 140. Bottom surface portions 132 of ribs 124 are intended to rest upon a surface such as a tabletop. In one embodiment, bottom surface portions 132 are co-planar with one another. In an alternative embodiment, bottom surface portions 132 extend downward and away from upper portion 104 as they extend towards central longitudinal axis 134.

Support surface 128 is a surface derived from the plurality of bottom surface portions 132 of ribs 124, and the amount of surface area of support surface 128 depends on the number of ribs 124 and the surface area of bottom surface portions 132 that are aligned with reference plane 142. In one embodiment, support surface 128 is generally flat and configured to be the surface of container 100 that interacts with a generally planar surface (e.g., a tabletop) along reference plane 142 when container 100 is positioned in its normal upright configuration, as illustrated in FIGS. 3 and 4. In an alternative embodiment, as bottom surface portions 132 extend toward central axis 134, they also extend away from upper portion 104 at a slight angle of approximately 0.5° to 10° such that only an inner portion 129 of support surface 128 interacts with a generally planar surface when container 100 is positioned in its upright configuration. In an alternative embodiment, bottom surface portions 132 extend away from upper portion at an angle of approximately 2.0° to 7.5°.

As illustrated in FIG. 3, voids 126 extend from inner core 130 to sidewall portion 106. Voids 126 have a length extending from inner core 130 to sidewall portion 106 and a width that extends perpendicular to their length. As voids 126 extend outward from central axis 134 toward sidewall portion 106, they extend slightly upward and toward upper portion 104. In one embodiment, the angle of incline towards upper portion 104 is between 0.5°-10°, In an alternative embodiment, voids 126 extend outward at an angle of 2.0°-7.5°. Voids 126 provide a mechanism to relieve pressure changes in container 100 during the hot filling process. Specifically, the width of voids 126 contract to accommodate pressure differentials within container 100 as described in more detail below with regard to FIG. 10E.

As illustrated in FIG. 4, relative to reference plane 142 of support surface 128, the angle that first radiused wall portion 138 extends from support surface 128 is greater than the angle that second radiused wall portion 140 extends from support surface 128. Inner core 130 has a generally conical shape extending toward contoured wall portion 136 which has an indented configuration relative to plane 142 and a chamber 103 of container body 102 and extends away from upper portion 104. In one embodiment, in the as blown configuration, second radiused wall portion 140 is linear. In another embodiment, second radiused wall portion 140 is slightly convex i.e., moving into the bottle in cross section in the as blown configuration. In one embodiment, in the post-fill, vacuum configuration of container 100, second radiused wall portion 140 is substantially linear relative to an outer surface of base portion 108. In an alternative embodiment, in the post-fill, vacuum configuration of container 100, second radiused wall portion 140 is concave relative to the outer surface of base portion 108.

Figure 5A:
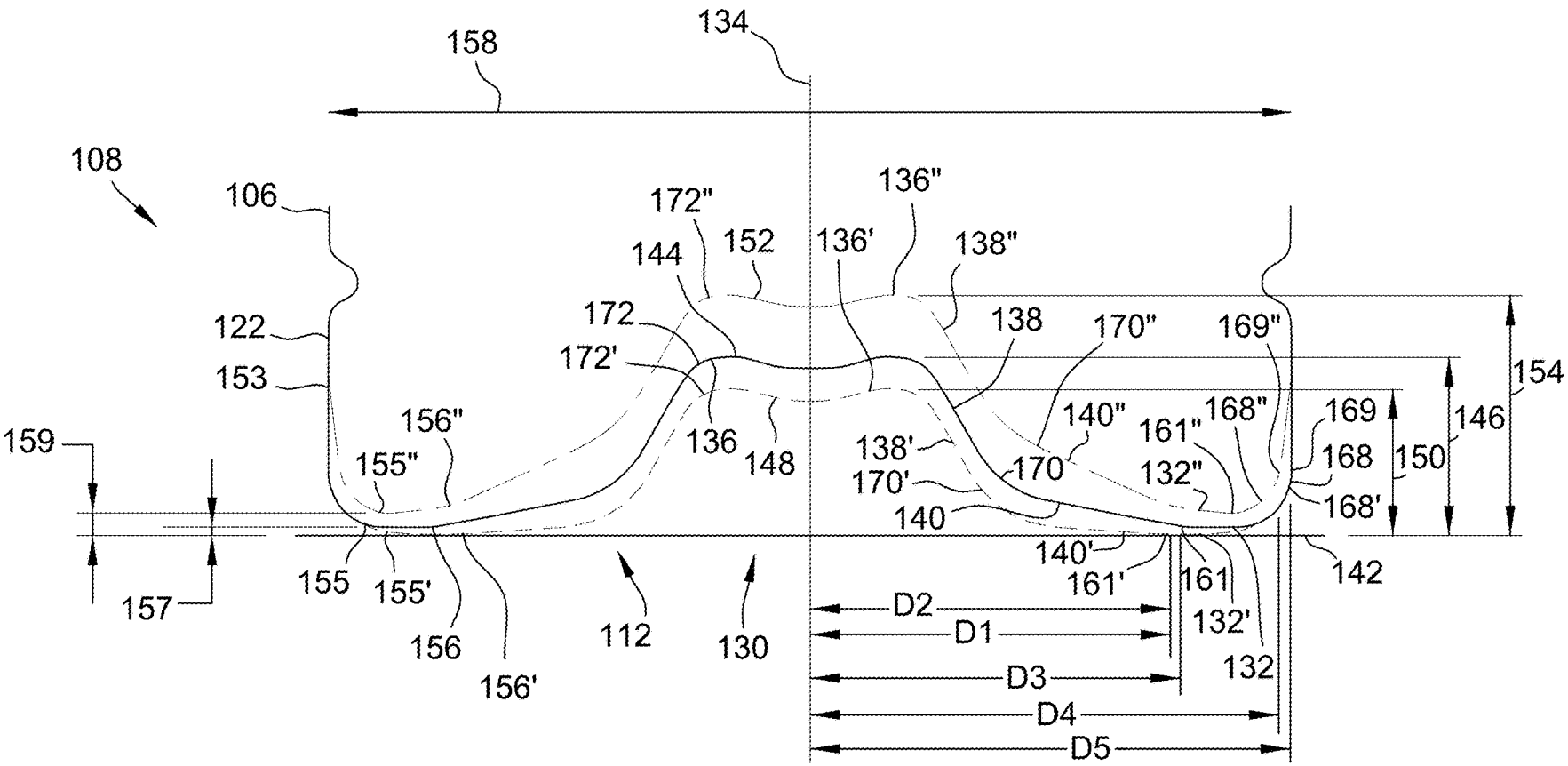
FIG. 5A is a cross-sectional detail view of the base of the container of FIG. 1 taken through the ribs of the base along line 4-4 of FIG. 2A, illustrating three positions of the base.
Figure 5B:
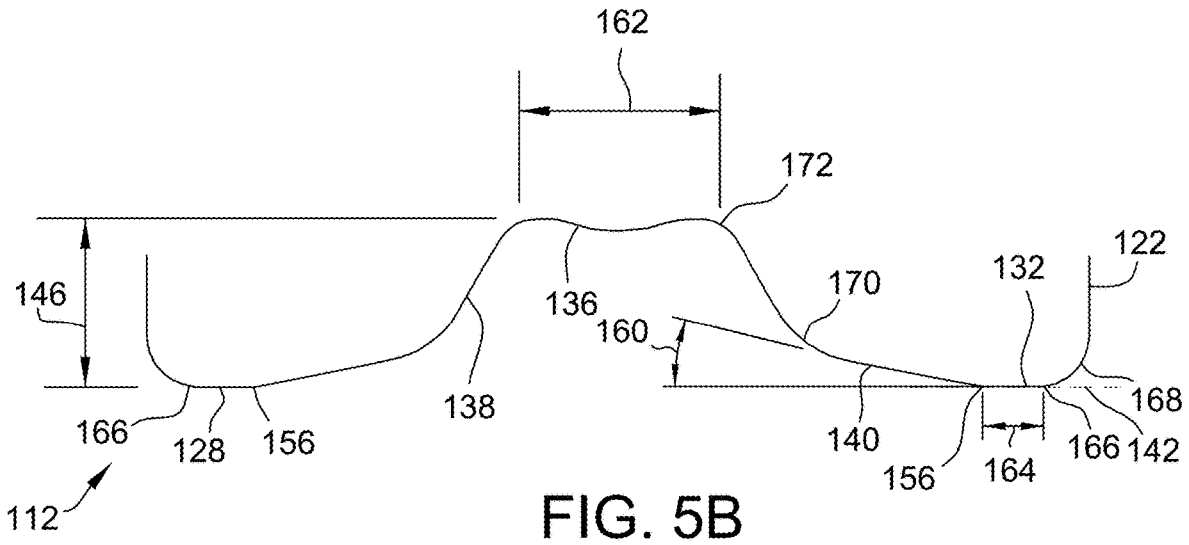
FIG. 5B is a cross-sectional detail view of the base of the container of FIG. 1 taken through the ribs of the base along line 4-4 of FIG. 2A showing additional details.

FIG. 5A is a cross-sectional detail view of base portion 112 taken through ribs 124 along line 4-4 of FIG. 2A. FIG. 5A illustrates three positions of base 112, a prefilled, or as molded, position, a filled and hot position, and a cooled and sealed position. FIG. 5B is a cross-sectional detail view of base 112 showing additional details with regard to the prefilled position. In the exemplary embodiment, base portion 112 is configured to be a variable dynamic base portion and is configured to move (e.g., deflect) in response to certain conditions, such as a pressure differential between the chamber and an exterior of container body 102. Base portion 112 may function as a diaphragm under certain pressure and/or temperature conditions and depending on the design parameters (dimensions, etc.) of the various elements of base portion 112.

As illustrated in FIGS. 5A and 5B, there are three configurations of inner core 130. A first position 144 is depicted by the solid line in FIG. 5A and represents a prefilled, or as molded position in which container 100 has not yet been filled. Contoured wall portion 136 has a corresponding first height 146 in such first position 144. A second position 148 is depicted by the dotted line in FIG. 5A. Second position 148 represents a hot filled position in which container 100 has been filled with a hot fluid and has not yet cooled. With regard to second position 148, contoured wall portion 136' has a corresponding second height 150 in second position 148. In the exemplary embodiment, second height 150 is less than first height 146. A third position 152 is depicted by the dashed line in FIG. 5A. Third position 152 represents a sealed and cooled position in which container 100 has been filled with a hot fluid, sealed, and cooled. In third position 152, contoured wall portion 136" has a corresponding third height 154. In the exemplary embodiment, third height 154 is greater than each of first height 146 and second height 150. Element numbers that include a prime notation, "'" refer to elements in second position 148. Numbers that include a double prime notation "'" refer to elements in third position 152.

As shown in FIG. 5B, base portion 112 includes a curved corner 168 that extends from a bottom 153 of sidewall portion 106 to an outer edge 155 of bottom surface portion 132. As shown in FIG. 5A, base portion 112 is active, i.e. subject to movement, during the hot filling, sealing and cooling of container 100.

As further illustrated in FIG. 5A, and in accordance with the exemplary embodiment, contoured wall portion 136, first radiused portion 138, and second radiused portion 140 are configured to move relative to other portions of container body 102, such as cylindrical base wall portion 122 and bottom surface portion 132. In the exemplary embodiment, as inner core 130 retracts deeper into container body 102 in third position 152 in response to sealing and cooling, third height 154 is greater than each of first height 146 and second height 150. In one embodiment, throughout this movement, container body 102 and base portion 112 maintain their desired circular shape. Additionally, in second position 148, second radiused portion 140' has a much flatter profile compared to reference plane 142 than in first position 144 or third position 152 and has a smaller pitch/angle relative to support surface 128. For example, relative to reference plane 142, the angle(s) of second radiused portion 140 are much steeper in third position 152 than in first position 144 and second position 148.

As further illustrated in FIG. 5A, second radiused portion 140 has an inclination start point at a hinge point 156 of base portion 112. Hinge point 156 delineates where second radiused portion 140 starts to rise from bottom surface portion 132. In the exemplary embodiment, an active base region 158 spans between bottom 153 of sidewall portion 106 on one side of container 100 to bottom 153 of sidewall portion 106 on the opposite side of container 100 and comprises an entirety of base portion 112. Under certain pressure scenarios as disclosed herein, active base region 158 functions as a diaphragm and is configured to move downward along axis 134 in a direction away from upper portion 104 in response to being filled with a hot liquid and to move upward along axis 134 in a direction toward upper portion 104 in response to a decrease in internal pressure, such as the creation of an internal vacuum within container 100 due to cooling of the fluid content of container 100. In an alternative embodiment, active region 158 is configured to restrict or resist movement during hot filling and allows for less restricted movement in an opposite direction during cooling of the fluid after container 100 is sealed. Base portion 112 therefore provides improved sensitivity and controlled deformation from applied forces, for example resulting from pressurized filling, sterilization or pasteurization, and resulting thermal expansion due to hot liquid contents and/or vacuum deformation due to cooling of a hot liquid product filled therein. Base portion 112 can also influence controlled deformation from positive container pressure, for example resulting from expansion of liquid at increased temperatures or elevations.

As illustrated in FIG. 5A, base portion 112 comprises inner core 130 which has a generally conical structure and shape, and includes contoured wall portion 136, first radiused portion 138, and second radiused portion 140. For example, second radiused portion 140 in one embodiment functions as a flange relative to contoured wall 136 and first radiused portion 138. Active base region 158 and inner core 130 are configured to remain substantially in first position 144 when an interior pressure is within a first threshold range of values. The first threshold range of values includes an upper threshold value that can be any value required to displace active base region 158 from first position 144 toward second position 148.

As shown in FIG. 5B, second radiused portion 140 has a first position angle 160 relative to support surface 128. In the exemplary embodiment, first position angle 160 is 11°. In an alternative embodiment, first position angle 160 is 10° to 12°. In a further alternative embodiment, first position angle 160 is 9° to 13°. In additional alternative embodiments, first position angle 160 can range from 1° to 25° depending on other design parameters including but not limited to a selected width of contoured wall portion 136. Hinge point 156 is a point where support surface 128 transitions to second radiused portion 140. Also shown in FIG. 5B is a first position width 162 of contoured wall portion 136, and a first position width 164 of support surface 128. First position width 164 represents a width of bottom flat portions 132 of each rib 124 and is configured to be in contact with a resting surface (e.g., tabletop) in a normal usage of container 100. In the exemplary embodiment, width 164 spans between hinge point 156 and a curve point 166 of base portion 112. Curve point 166 defines the point where curved corner 168 of bottom portion 112 of container body 102 extends from outer edge 155 of support surface 128. Curved corner 168 extends to cylindrical base wall portion 122. A first transition curve portion 170 extends between first radiused portion 138 and second radiused portion 140. A second transition curve portion 172 extends between first radiused portion 138 and contoured wall portion 136. Second radiused portion 140 extends from hinge point 156 to first transition curve portion 170. The angled configuration of first radiused portion 138 comprises an angle that can be derived in a similar manner as angle 160 (e.g., with respect to a plane (e.g., 142) associated with support surface 128). In first position 144, first radiused portion 138 extends from second radiused portion 140 at an angle. In the exemplary embodiment, height 146 is equivalent to the axial distance between hinge point 156 or curve point 166 and second transition curve portion 172, i.e., the overall height of inner core 130 as measured from support surface 128 to second transition curve portion 172.

FIGS. 5A and 5B illustrate the variety of arcuate portions of inner core 130, including contoured wall portion 136, first radiused portion 138, second radiused portion 140, first transition curve portion 170, and second transition curve portion 172, and transition points such as hinge point 156 and curve point 166. Hinge point 156 and curve point 166 delineate where portions of base portion 112 transition from one configuration to another. For example, starting from cylindrical base wall portion 122, the following transitions are present: cylindrical base wall portion 122 transitions to curved corner 168; curved corner 168 transitions to flat bottom portion 132 of rib 124 at curve point 166; flat bottom portion 132 of rib 124 transitions to second radiused wall portion 140 at hinge point 156; second radiused wall portion 140 transitions to first radiused wall portion 138 at first transition curve portion 170; and first radiused wall portion 138 transitions to contoured wall portion 136 at second curve portion 172.

The dimensions and angles of the various features of base portion 112 can be selected to tailor the overall performance of base portion 112 as desired. For example, the radius and/or angle of curvature of first and second radiused portions 138 and 140, the distances therebetween, the thickness, and the lengths can be modified to increase or decrease the response of base portion 112 to pressure differentials to accommodate a range of thermodynamic environments, such as variations in hot-fill filling lines. Additionally, the amount of curvature of first and second radiused portions 138 and 140 and/or angle of curvature of these portions relative to a reference plane (e.g., 142) defined by support surface 128 can be selected for the desired response to pressure differentials to affect the efficiency of base portion 112 deformation. While not shown, any suitable variety of angular, height, and/or other dimensional relationships can be set for the various portions of base portion 112, including first and radiused portions 138 and 140, hinge point 156, curve point 166, and other portions disclosed herein. While not shown in the figures, movement in active base region 158 can be split into sub-regions and depending on the particular design and characteristics of each of contoured wall portion 136, first radiused portion 138, second radiused portion 140, flat bottom portion 132 and curved corner 168, the amount of flex or deformation for each sub-region may vary.

In the exemplary embodiment, during a hot-filling process, the internal bottle pressure increases from an initial pressure to an elevated pressure when container 100 is filled with a hot liquid and then sealed. Active base region 158 is configured to react in a controlled manner, such that active base region 158 begins to move towards second position 148 when the internal pressure of container 100 exceeds the first threshold range upper value. As the internal pressure continues to increase beyond the first threshold range upper value, active base region 158 continues to move towards second position 148 until the internal pressure reaches a second threshold value at second position 148.

At second position 148, active base region 158 has moved in a direction opposite upper portion 104 along axis 134 except that only a small section of curved corner 168 which is closest to curve point 166 moves with the remainer of active base region 158. This movement causes base portion 112 to extend away from upper portion 104 a distance 157 such that a length of container 100, i.e., the distance from upper portion 104 top to the active base region point of contact 161' with planar surface 142 is increased by distance 157. First position angle 160 is decreased in this position and the radius of curvature of first transition curve 170' increases causing a shallower inner core 130 at second position 148 compared to first position 144. The radius of curvature of second curve portion 172' remains substantially the same in second position 148 compared to first position 144.

Additionally, active base region 158 is configured to move from second position 148 toward first position 144 as the internal pressure decreases below the second threshold value during a cooling process. As cooling continues and the pressure continues to decrease, inner core 130 continues to move toward first position 144 and then past first position 144. Once the liquid and bottle are completely cooled, the pressure inside container 100 reaches a third threshold value and active base region 158 reaches third position 152 and maintains third position 152 until container 100 is opened.

At third position 152, the entire active base region 158 has moved in a direction toward upper portion 104 along axis 134, including curved corner 168. This movement causes base portion 112 to draw inward along axis 134 toward upper portion 104 such that the active base region point of contact 161" with planar surface 142 has moved toward upper portion 104 a distance 159 compared to the active base point of contact 161 with planar surface 142 at first position 144. At third position 152, active base region 158 begins at sidewall portion bottom 153. Curved corner 168" moves inward toward axis 134 and upward toward upper portion 104 such that the radius of curvature of curved corner 168" has decreased. Bottom surface portion 132" has moved toward upper portion 104 in a direction towards axis 134. Second radiused portion 140 extends from bottom surface portion 132" at an angle that is greater than the angle of extension in either first position 144 or second position 148. First transition curve portion 170" has a radius of curvature that is greater than the radius of curvature of first transition curve portion 170 in first position 144 or first transition curve portion 170' in second position 148. The radius of curvature of second transition curve portion 172" is substantially the same as the radius of curvature of second transition curve portion 172 in first position 144 and second transition curve portion 172' in second position 148. However, in at least some embodiments, the heat from the hot fill process causes second transition curve portion 172" to warp compared to second transition curve portion 172 prior to being hot filled. Again, the warping is not due to vacuum pressures, rather it is caused by the heat of the fluid. At first position 144, container 100 contacts planar surface 142 along an entirety of support surface 128 and an inner most, i.e., closest to axis 134, contact point of container 100 is a distance D1 from axis 134. In an alternative embodiment, less than an entirety of support surface 128 contacts planar surface 142. At second position 148, container 100 contacts planar surface 142 along a portion of support surface 128' and at a point inside of support surface 128'. The point inside of support surface 128' is a distance D2 from axis 134. In this embodiment, D2 is less than D1. In an alternative embodiment, at second position 148, support surface 128' does not contact planar surface 142. At third position 152, support surface 128" is angled toward upper portion 104 in a direction towards axis 134. Support surface 128" contacts planar surface 142 at an outer region of support surface 128" at a distance D3 from axis 134. Distance D3 is greater than either D1 or D2.

As explained above, as base portion 112 transitions from first position 144 to second position 148 and then to third position 152, curved corner along ribs 124 moves towards axis 134. This movement is shown in FIG. 5A as distances D4 and D5. Distance D5 is the distance from axis 134 to the point on base wall portion 122 that is a transition point 169 from a straight base wall portion to an initial curvature of curved corner 168. As base portion 112 moves from first position 144 to second position 148, transition point 169 does not move. As base portion 112 moves from second position 148 to third position 152, transition point 169" moves toward axis 134 and is then positioned a distance D4 from axis 134. In this embodiment, D4 is less than D5.

Figure 6:
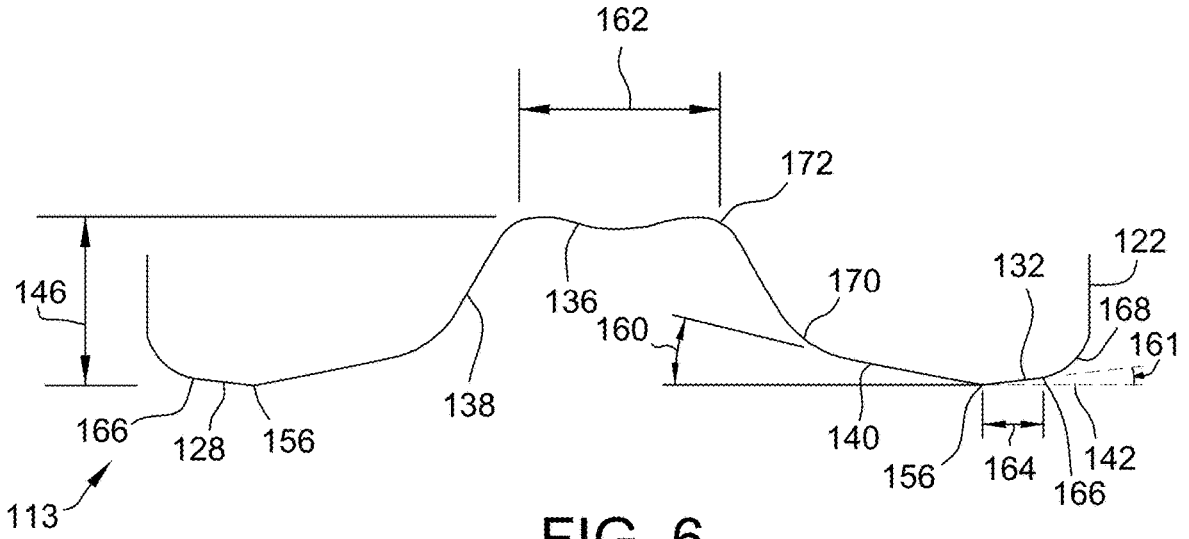
FIG. 6 is a cross-sectional detail view of an alternative base taken through the ribs of the base along a line similar to line 4-4 of FIG. 2A.

FIG. 6 is a cross-sectional detail view of an alternative base 113 along a line similar to line 4-4 of FIG. 2A. For ease of reference, the element numbering in FIG. 6 is the same as the element numbering of FIG. 5B for like components. As illustrated in FIG. 6, flat bottom portion 128 is inclined toward upper portion 104 as it extends from hinge point 156 toward cylindrical base wall portion 122. Additionally, curved corner 168 has a slightly flatter curvature as it extends from curve point 166 to cylindrical base wall portion 122 compared to base portion 112 shown in FIG. 5B. In this embodiment, the inclined configuration of flat bottom portion 132 128 reduces the surface area of flat bottom portion 132 that actually contacts a supporting surface, such as a tabletop. As illustrated in FIG. 6, base 113 contacts the supporting surface only at, or near, hinge point 156. In one embodiment, the angle of inclination 161 of flat bottom portion 132 is between 0.5° and 10.0°. In an alternative embodiment, angle of inclination 161 of flat bottom portion 132 is between 2° and 7°. In a further alternative embodiment, angle of inclination 161 of flat bottom portion 132 is 5°.

Figure 7A:
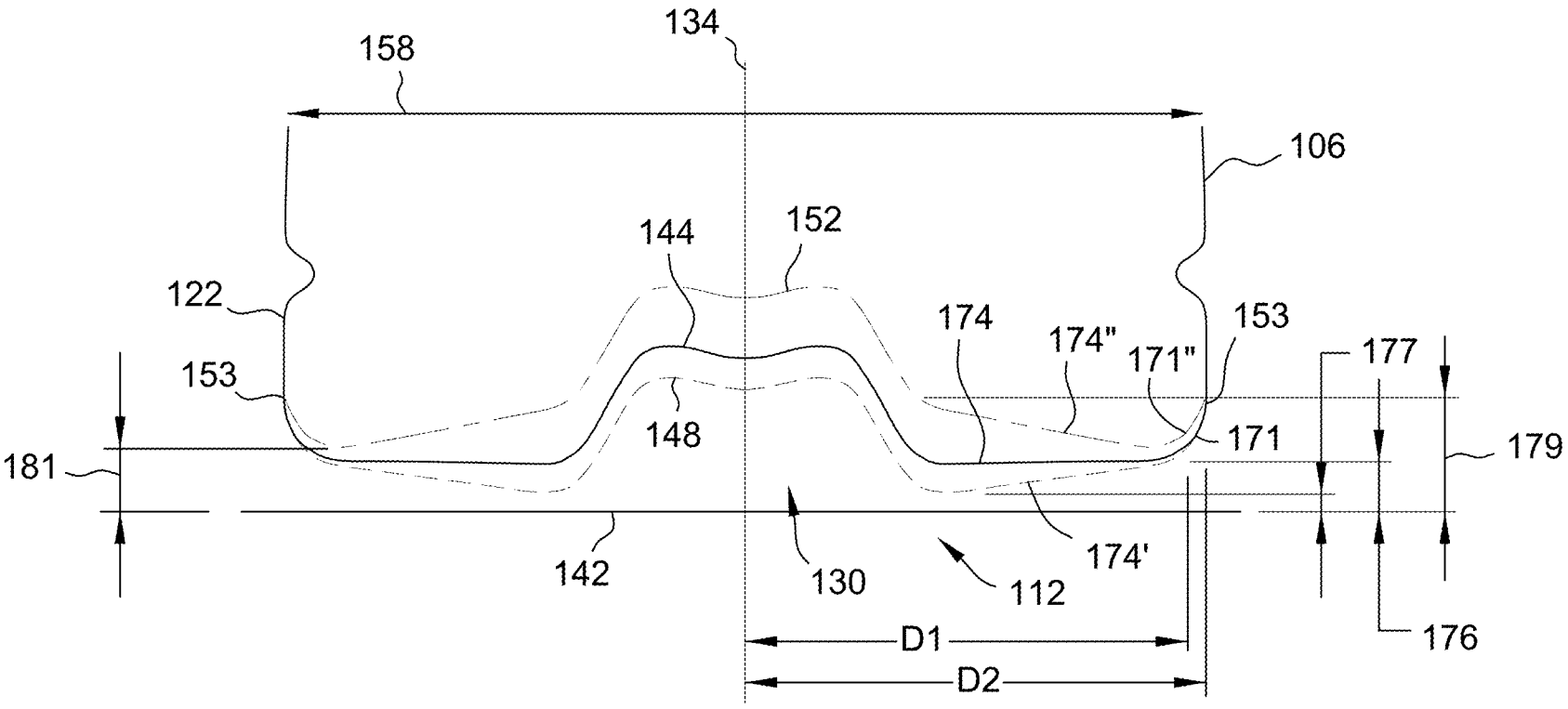
FIG. 7A is a cross-sectional detail view of the base of the container of FIG. 1 taken through the voids of the base along line 3-3 of FIG. 2A illustrating three positions of the base.
Figure 7B:
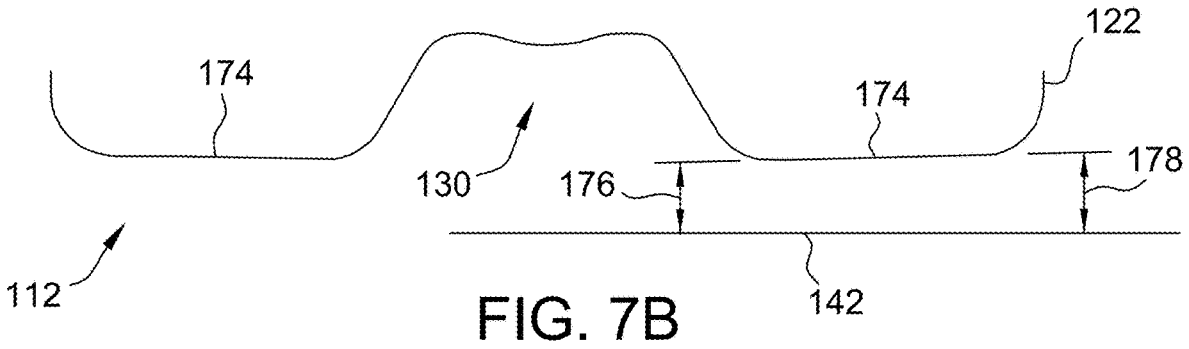
FIG. 7B is a cross-sectional detail view of the container of FIG. 1 taken through the voids of the base along line 3-3 showing additional details.

FIG. 7A is a cross-sectional detail view of base portion 112 taken through voids 126 along line 3-3 of FIG. 2A. FIG. 7A illustrates three positions of base 112, a prefilled, or as molded, position, a filled and hot position, and a cooled and sealed position. FIG. 7B is a cross-sectional detail view of base 112 showing additional details with regard to the prefilled position. As illustrated in FIGS. 7A and 7B, the three configurations of inner core 130 are depicted. For ease of reference, the element numbering in FIGS. 7A and 7B are the same as the element numbering of FIGS. 5A and 5B for like components. First position 144 is depicted by the solid line, second position 148 is depicted by the dotted line and third position 152 is depicted by the dashed line.

As shown in FIG. 7B, base 112 includes an upper surface 174 of voids 126. Upper surface 174 is inclined toward upper portion 104 as it extends from inner core 130 to cylindrical base wall portion 122. Accordingly, a height 176 of upper surface 174 from reference plane 142 adjacent inner core 130 is smaller than a height 178 of upper surface 174 from reference plane 142 at a location where upper surface 174 approaches cylindrical base wall portion 122. In one embodiment, the angle of inclination of upper surface 122 is between 0.5° and 10.0°.

As depicted in FIG. 7A, as active base region 158 moves downward along axis 134 in a direction away from upper portion 104 to second position 148, void upper surface 174 moves in a similar direction. In second position 148, the angle of inclination of void upper surface 174' is greater than in first position 144 since inner core 130 moves downward and has a height 177 of upper surface 174' from reference plane 142. Height 177 is less than height 176. In third position 152, the angle of inclination of void inner surface 174" reverses such that void inner surface 174" angles away from upper portion 104 as it extends from inner core 130 to base wall portion 122. Accordingly, a height 179 of void inner surface 174" from reference plane 142 adjacent inner core 130 is larger than a height 181 of upper surface 174" from reference plane 142 at a location where upper surface 174" approaches base wall portion 122.

As explained above, as base portion 112 transitions from first position 144 to second position 148 and then to third position 152, curved corner along voids 126 moves towards axis 134. This movement is shown in FIG. 7A as distances D1 and D2. Distance D2 is the distance from axis 134 to the point on base wall portion 122 that is a transition point 171 from a straight base wall portion to an initial curvature of curved corner 168. As base portion 112 moves from first position 144 to second position 148, transition point 171 does not move. As base portion 112 moves from second position 148 to third position 152, transition point 171" moves toward axis 134 and is then positioned a distance D1 from axis 134. In this embodiment, D1 is less than D2.

Figure 8:
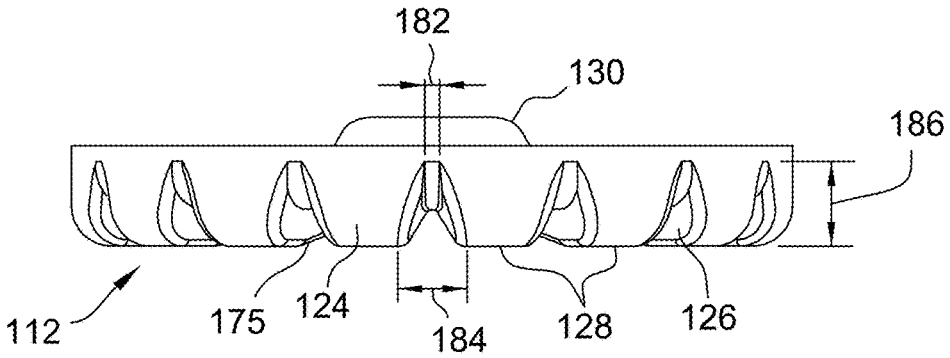
FIG. 8 illustrates a front view of an embodiment of a base portion such as illustrated in FIGS. 2J and 2K.

FIG. 8 illustrates a front view of an embodiment of base portion 112 such as illustrated in FIGS. 2J and 2K, showing a height relationship between ribs 124, voids 126, and contoured wall portion 136 of inner core 130 (via the partial cut-away view of FIG. 8). Support surface 128 is comprised of flat portions 132 (see FIGS. 2C, 2E, 2G, 2I, 2K, 2M, 2O, 2Q, 2S and 6) of ribs 124. Ribs 124 and voids 126 are arranged in an alternating fashion (e.g., rib 124/void 126/rib 124/void 126, and so on and so forth). As shown, each void 126 has a tapered shape from upper surface 174 to a lower gap portion 175, where the width of void 126 varies therebetween. For example, as illustrated in FIG. 8, the width of void 126 is largest at lower gap portion 175 and gradually decreases to its smallest width at upper surface 174. FIG. 8 illustrates a first width 182 of void 126, a second width 184 of void 126 greater than first width 182, and a height 186 of void 126. Table 1 lists dimensions for these quantities.

Figure 9B:
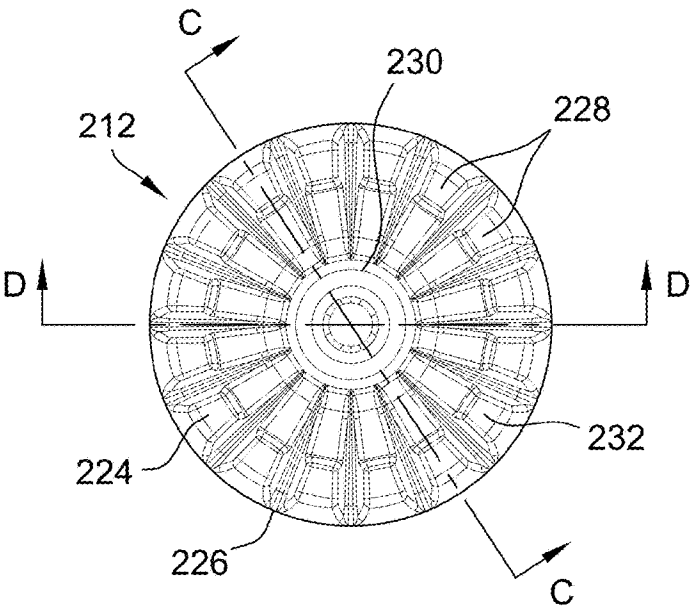
FIG. 9B is a bottom view of the container of FIG. 9A.
Figure 9A:
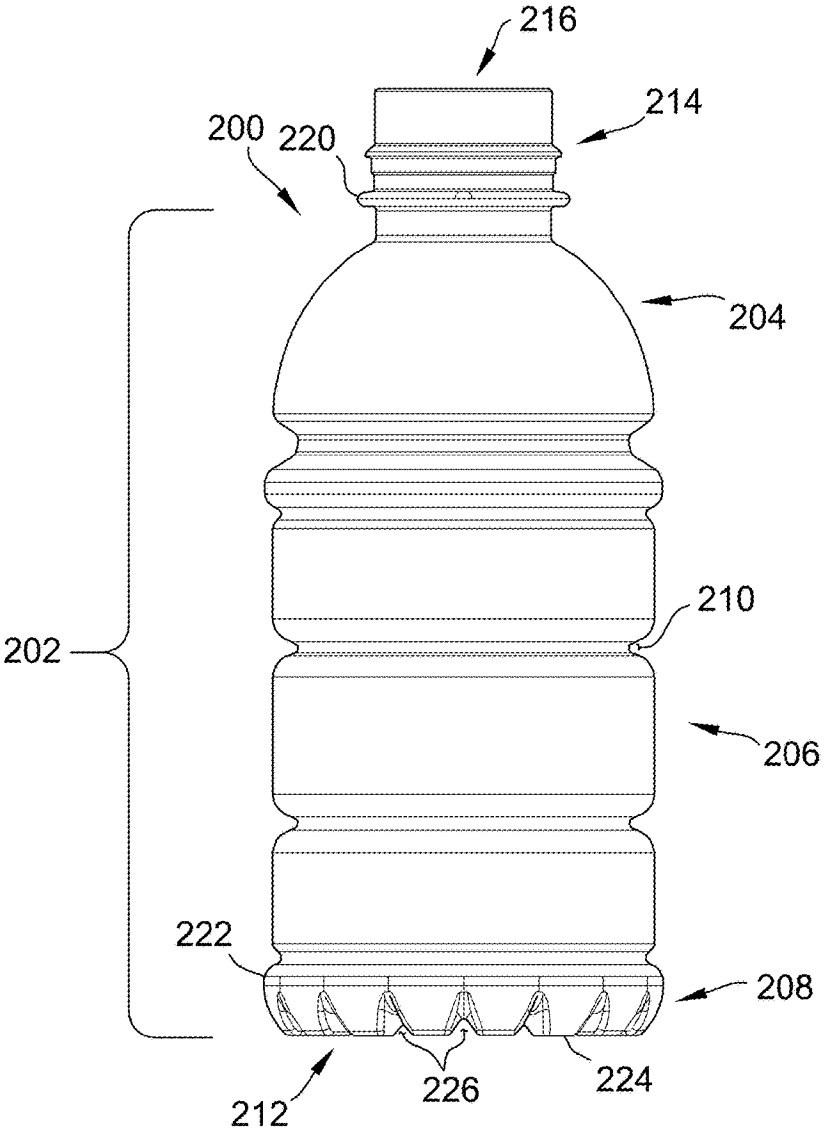
FIG. 9A is a front view of another embodiment of the container as disclosed herein.

FIGS. 9A-9D depict an alternative container 200 (e.g., a hot-fillable plastic container, more specifically a hot-fillable plastic bottle). As depicted in FIGS. 9A and 9B, container 200 comprises a container body 202 having an upper portion 204, a sidewall portion 206, and a bottom portion 208. Sidewall portion 206 includes at least one circumferential indent 210 and is located between upper portion 204 and bottom portion 208. Bottom portion 208 includes a base portion 212. In one embodiment, indents 210 are located in sidewall portion 206. Container body 202 defines a chamber (not shown) therein for containing fluids (e.g., liquid product such as waters, sports drinks, alcoholic beverages) and/or foods (e.g., apple sauce). Additionally, container body 202 includes a finish portion 214 extending from upper portion 204 and defining a mouth 216 in fluid communication with the chamber. Finish portion 214 can have a variety of configurations, and in the exemplary embodiment, includes a fastener or other engagement mechanism such as a flange 220. Flange 220 is for engaging a cap (not shown) or other closure member (not shown) of the container. These elements have an orientation and capping features as known in the art.

In the exemplary embodiment, sidewall portion 206 is formed with circumferential indents 210, which can also be referred to as grooves, rings, ribs, or beads. As shown in FIG. 9A, a plurality of indents 210 extend about an entire circumference of container 200, such circumference being relative to a particular diameter of any given section of container 200 where indents 210 are to be located. In the exemplary embodiment, a shape and width of container 200 varies from bottom to top as shown in FIG. 9A.

As illustrated in this embodiment, and as shown in FIGS. 9A and 9B, bottom portion 208 includes base portion 212 comprising a cylindrical base wall portion 222, a plurality of ribs 224, a plurality of voids 226, a support surface 228 defining a reference plane 242 (shown in FIG. 9C), and an inner core 230. Each rib 224 includes a bottom surface portion 232 which is angled upward towards finish portion 214 as it extends toward cylindrical wall portion 222. Support surface 228 is comprised of bottom surface portions 232 of plurality of ribs 224. The combination of features 222, 224, 226, 228 and 230 and their respective structural/physical configurations enable base portion 212 to function as a variable dynamic base portion capable of moving in response to certain forces (e.g., pressure).

Support surface 228 is a surface derived from the plurality of bottom surface portions 232 of ribs 224, and the amount of surface area of support surface 228 depends on the number of ribs 224 and the surface area of bottom surface portions 232 that are aligned with reference plane 242. In one embodiment, bottom surface portions 232 extend at an angle 233 such that as bottom surface portions 232 extend toward central axis 234, they also extend away from upper portion 104 at a slight angle such that only an inner portion 229 of support surface 228 interacts with a generally planar surface when container 200 is positioned in its upright configuration. In one embodiment, angle 233 is approximately 0.5° to 10°. In an alternative embodiment, angle 233 is approximately 2.0° to 7.5°. In a further embodiment, angle 233 is approximately 5°.

As illustrated in FIG. 9B, plurality of ribs 224 and plurality of voids 226 of base portion 212 are arranged in a radial configuration around inner core 230. A variety of suitable configurations can be used for ribs 224 and voids 226 in accordance with the disclosed subject matter.

Figure 9C:
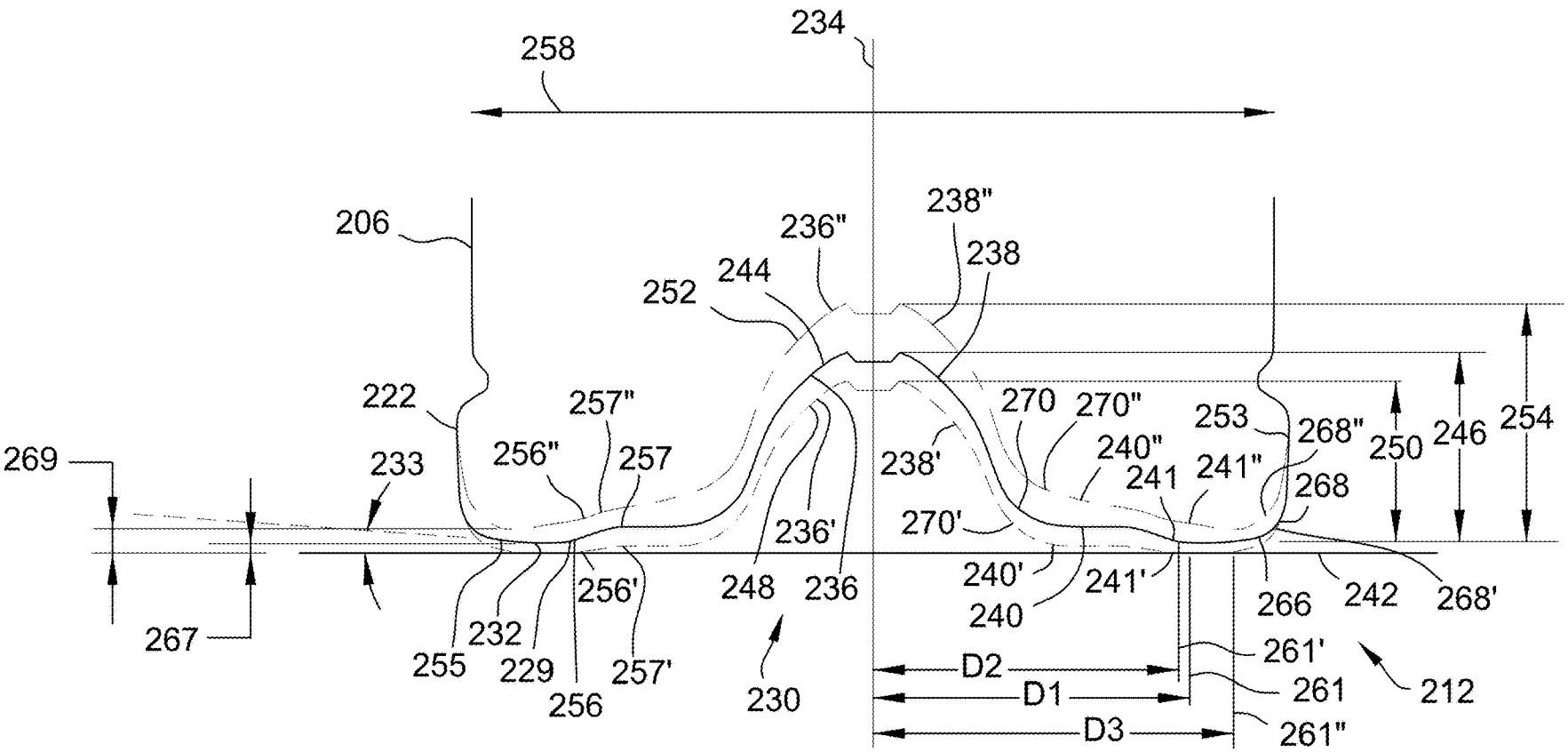
FIG. 9C is a cross-sectional detail view of the base of the container of FIG. 9A taken through the ribs of the base along line C-C of FIG. 9B, illustrating three positions of the base.
Figure 9D:
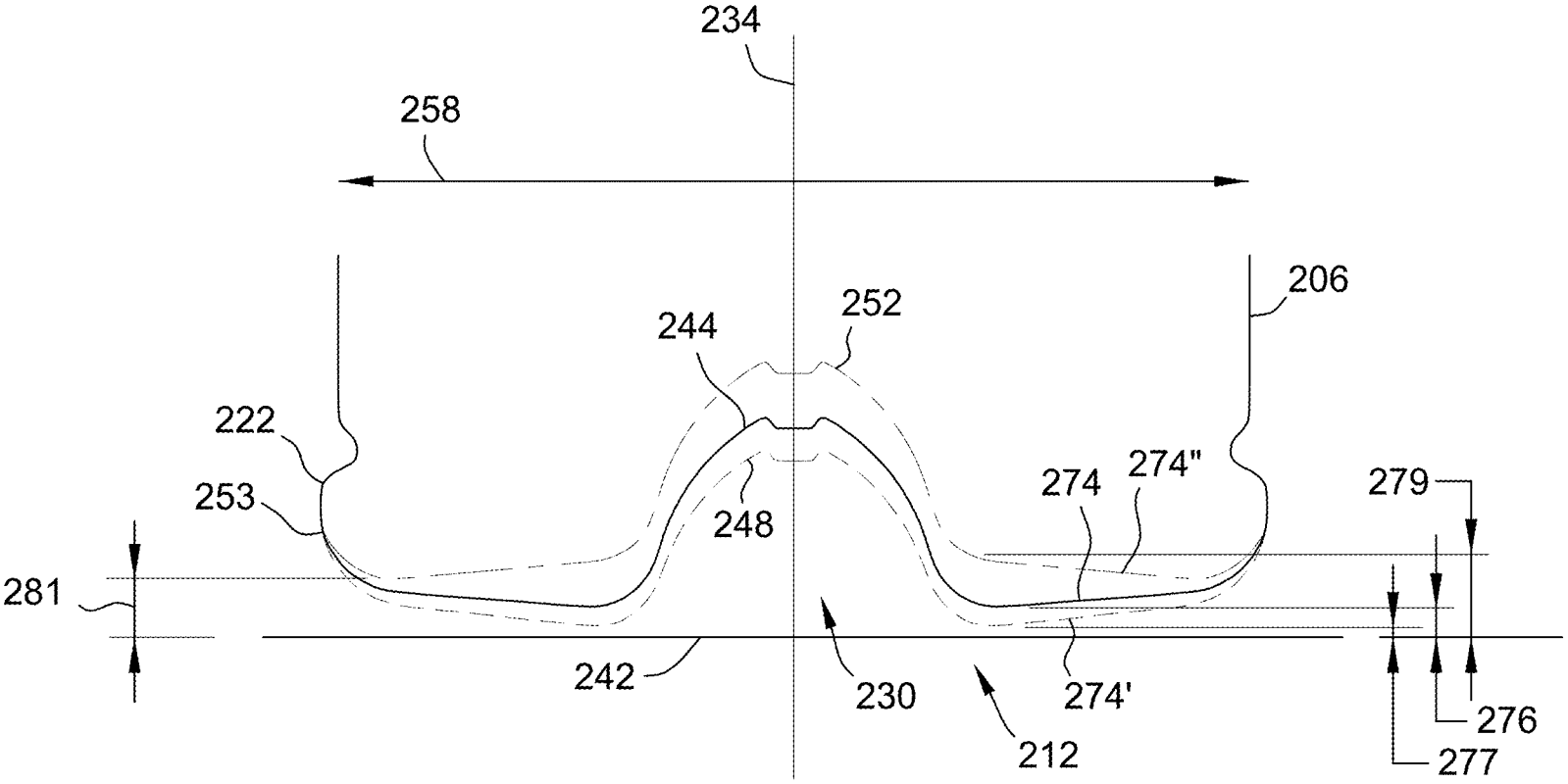
FIG. 9D is a cross-sectional detail view of the base of the container of FIG. 9A taken through the voids of the base along line D-D of FIG. 9B illustrating three positions of the base.

FIG. 9C is a cross-sectional detail view of base portion 212 taken through ribs 224 along line C-C of FIG. 9B. FIG. 9C illustrates three positions of base 212, a prefilled, or as molded, position, a filled and hot position, and a cooled and sealed position. FIG. 9D is a cross-sectional detail view of base 212 showing additional details with regard to the prefilled position. In the exemplary embodiment, base portion 212 is configured to be a variable dynamic base portion and is configured to move (e.g., deflect) in response to certain conditions, such as a pressure differential between the chamber and an exterior of container body 202. Base portion 212 may function as a diaphragm under certain pressure and/or temperature conditions and depending on the design parameters (dimensions, etc.) of the various elements of base portion 212.

As illustrated in FIGS. 9C and 9D, there are three configurations of inner core 230. A first position 244 is depicted by the solid line in FIG. 9C and represents a prefilled, or as molded, position in which container 200 has not yet been filled. Contoured wall portion 236 has a corresponding first height 246 in such first position 244. A second position 248 is depicted by the dotted line in FIG. 9C. Second position 248 represents a hot filled position in which container 200 has been filled with a hot fluid and has not yet cooled. With regard to second position 248, contoured wall portion 236' has a corresponding second height 250 in second position 248. In the exemplary embodiment, second height 250 is less than first height 246. A third position 252 is depicted by the dashed line in FIG. 9C. Third position 252 represents a sealed and cooled position in which container 200 has been filled with a hot fluid, sealed, and cooled. In third position 252, contoured wall portion 236" has a corresponding third height 254. In the exemplary embodiment, third height 254 is greater than each of first height 246 and second height 250. Element numbers that include a prime notation, "'" refer to elements in second position 248. Numbers that include a double prime notation "'" refer to elements in third position 252.

As shown in FIG. 9C, base portion 212 includes a curved corner 268 that extends from a bottom 253 of sidewall portion 206 to an outer edge 255 of bottom surface portion 232. As shown in FIG. 9C, base portion 212 is active, i.e. subject to movement, during the hot filling sealing and cooling of container 200.

As further illustrated in FIG. 9C, base portion 212 includes a step portion 241 positioned between bottom surface portion 232 and second radiused portion 240. In accordance with this alternative embodiment, contoured wall portion 236, first radiused portion 238, second radiused portion 240 and stepped portion 241 are configured to move relative to other portions of container body 202, such as cylindrical base wall portion 222 and bottom surface portion 232. In the exemplary embodiment, as inner core 230 retracts deeper into container body 202 in third position 252 in response to sealing and cooling, third height 254 is greater than each of first height 246 and second height 250. In one embodiment, throughout this movement, container body 202 and base portion 212 maintain their desired circular shape. Additionally, in second position 248, second radiused portion 240' and step portion 241' have a much flatter profile compared to reference plane 242 than in first position 244 or third position 252 and has a smaller pitch/angle relative to bottom surface portion 232. After step portion 241' has flattened out along reference plane 242 in second position 248, second radiused portion 240' remains a further distance from reference plane 242 than the distance of bottom surface portion 232' to reference plane 242. At third position 252, step portion 241" remains relatively flat but is inclined toward upper portion 204 as it extends toward axis 234.

As further illustrated in FIG. 9C, step portion 241 has an inclination start point at a hinge point 256 of base portion 212. Hinge point 256 delineates where step portion 241 starts to rise from bottom surface portion 232. Step portion 241 transitions to second contoured wall 240 at a second hinge point 257. In this embodiment, an active base region 258 spans between bottom 253 of sidewall portion 206 on one side of container 200 to bottom 253 of sidewall portion 206 on the opposite side of container 200 and comprises an entirety of base portion 212. Under certain pressure scenarios as disclosed herein, active base region 258 functions as a diaphragm and is configured to move downward along axis 234 in a direction away from upper portion 204 in response to being filled with a hot liquid and to move upward along axis 234 in a direction toward upper portion 204 in response to a decrease in internal pressure, such as the creation of an internal vacuum within container 200 due to cooling of the fluid content of container 200. In an alternative embodiment, active region 258 is configured to restrict or resist movement during hot filling and allows for less restricted movement in an opposite direction during cooling of the fluid after container 200 is sealed. Base portion 212 therefore provides improved sensitivity and controlled deformation from applied forces, for example resulting from pressurized filling, sterilization or pasteurization, and resulting thermal expansion due to hot liquid contents and/or vacuum deformation due to cooling of a hot liquid product filled therein. Base portion 212 can also influence controlled deformation from positive container pressure, for example resulting from expansion of liquid at increased temperatures or elevations.

As illustrated in FIG. 9C, base portion 212 comprises inner core 230 which has a generally dome structure and shape, and includes contoured wall portion 236, first radiused portion 238, and second hinge point 257. Active base region 258 and inner core 230 are configured to remain substantially in first position 244 when an interior pressure is within a first threshold range of values. The first threshold range of values includes an upper threshold value that can be any value required to displace active base region 258 from first position 244 toward second position 248.

As shown in FIG. 9C, step portion 241' and second hinge point 257' enable second contoured wall 240' to deflect away from upper portion 204 and still remain a distance way from reference plane 242. Additionally, curved corner 268 extends to cylindrical base wall portion 222. A first transition curve portion 270 extends between first radiused portion 238 and second radiused portion 240.

FIGS. 9C and 9D illustrate the variety of arcuate portions of inner core 230 and active base 258. For example, starting from cylindrical base wall portion 222, the following transitions are present: cylindrical base wall portion 222 transitions to curved corner 268; curved corner 268 transitions to flat bottom portion 232 at curve point 266; flat bottom portion 232 transitions to step portion 241 at hinge point 256; step portion 241 transitions to second radiused wall at second hinge point 257; second radiused wall portion 240 transitions to first radiused wall portion 238 at first transition curve portion 270; and first radiused wall portion 238 transitions to contoured wall portion 236.

The dimensions and angles of the various features of base portion 212 can be selected to tailor the overall performance of base portion 212 as desired. For example, the radius and/or angle of curvature of first and second radiused portions 238 and 240, the distances therebetween, the thickness, and the lengths can be modified to increase or decrease the response of base portion 212 to pressure differentials to accommodate a range of thermodynamic environments, such as variations in hot-fill filling lines. Additionally, the amount of curvature of first and second radiused portions 238 and 240 and/or angle of curvature of these portions relative to a reference plane (e.g., 242) defined by support surface 228 can be selected for the desired response to pressure differentials to affect the efficiency of base portion 212 deformation. While not shown, any suitable variety of angular, height, and/or other dimensional relationships can be set for the various portions of base portion 212, including first and second radiused portions 238 and 240, hinge points 256 and 257, curve point 266, and other portions disclosed herein. While not shown in the figures, movement in active base region 258 can be split into sub-regions and depending on the particular design and characteristics of each of contoured wall portion 236, first radiused portion 238, second radiused portion 240, flat bottom portion 232 and curved corner 268, the amount of flex or deformation for each sub-region may vary.

In the exemplary embodiment, during a hot-filling process, the internal bottle pressure increases from an initial pressure to an elevated pressure when container 200 is filled with a hot liquid and then sealed. Active base region 258 is configured to react in a controlled manner, such that active base region 258 begins to move towards second position 248 when the internal pressure of container 200 exceeds the first threshold range upper value. As the internal pressure continues to increase beyond the first threshold range upper value, active base region 258 continues to move towards second position 248 until the internal pressure reaches a second threshold value at second position 248.

At second position 248, active base region 258 has moved in a direction opposite upper portion 204 along axis 234 except that only a small section of curved corner 268 which is closest to curve point 266 moves with the remainer of active base region 258. This movement causes base portion 212 to extend away from upper portion 204 a distance 267 such that a length of container 200, i.e., the distance from upper portion 204 top to an active base region point of contact 261' with planar surface 242 is increased by distance 267. The radius of curvature of first transition curve 270' increases causing a shallower inner core 230 at second position 248 compared to first position 244.

Additionally, active base region 258 is configured to move from second position 248 toward first position 244 as the internal pressure decreases below the second threshold value during a cooling process. As cooling continues and the pressure continues to decrease, inner core 230 continues to move toward first position 244 and then past first position 244. Once the liquid and bottle are completely cooled, the pressure inside container 200 reaches a third threshold value and active base region 258 reaches third position 252 and maintains third position 252 until container 200 is opened.

At third position 252, the entire active base region 258 has moved in a direction toward upper portion 204 along axis 234, including curved corner 268. This movement causes base portion 212 to draw inward along axis 234 toward upper portion 204 such that the active base region point of contact 261" with planar surface 242 has moved toward upper portion 204 a distance 269 compared to the active base point of contact 261 with planar surface 242 at first position 244. At third position 252, active base region 258 begins at sidewall portion bottom 253. Curved corner 268" moves inward toward axis 234 and upward toward upper portion 204 such that the radius of curvature of curved corner 268" has decreased. Bottom surface portion 232" has moved toward upper portion 204 and in a direction towards axis 234. At first position 244, container 200 contacts planar surface 242 along an entirety of support surface 228 and an inner most, i.e., closest to axis 234, contact point of container 200 is a distance D1 from axis 234. In an alternative embodiment, less than an entirety of support surface 228 contacts planar surface 242. At second position 248, container 200 contacts planar surface 242 along a portion of support surface 228' and at a point inside of support surface 228'. The point inside of support surface 228' is a distance D2 from axis 234. In this embodiment, D2 is less than D1. In an alternative embodiment, at second position 248, support surface 228' does not contact planar surface 242. At third position 252, support surface 228" is angled toward upper portion 204 in a direction towards axis 234. Support surface 228" contacts planar surface 242 at an outer region of support surface 228" at a distance D3 from axis 234. Distance D3 is greater than either D1 or D2.

As depicted in FIG. 9D, as active base region 258 moves downward along axis 234 in a direction away from upper portion 204 to second position 248, void upper surface 274 moves in a similar direction. In second position 248, the angle of inclination of void upper surface 274' is greater than in first position 244 since inner core 230 moves downward and has a height 277 of upper surface 274' from reference plane 242. Height 277 is less than height 276. In third position 252, the angle of inclination of void inner surface 274" reverses such that void inner surface 274" angles away from upper portion 204 as it extends from inner core 230 to base wall portion 222. Accordingly, a height 279 of void inner surface 274" from reference plane 242 adjacent inner core 230 is larger than a height 281 of upper surface 274" from reference plane 242 at a location where upper surface 274" approaches base wall portion 222.

Figure 10B:
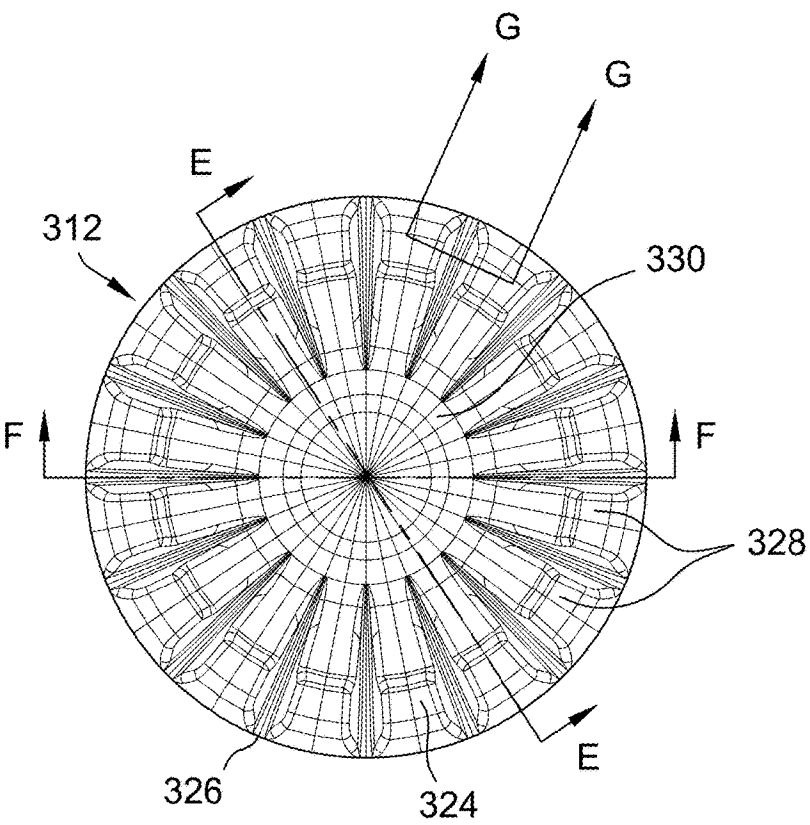
FIG. 10B is a bottom view of the container of FIG. 10A.
Figure 10A:
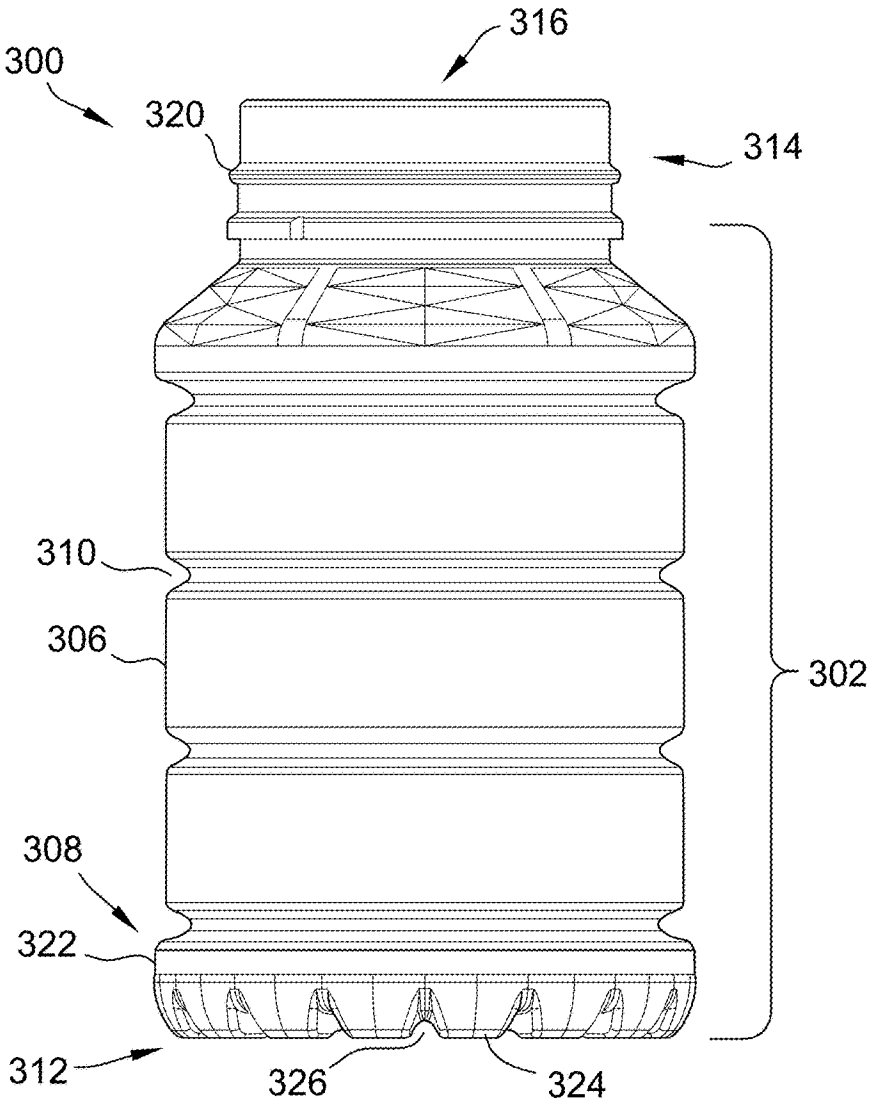
FIG. 10A is a front view of another embodiment of the container as disclosed herein.

FIGS. 10A-10E depict an alternative container 300 (e.g., a hot-fillable plastic container, more specifically a hot-fillable plastic bottle). As depicted in FIGS. 10A and 10B, container 300 comprises a container body 302 having an upper portion 304, a sidewall portion 306, and a bottom portion 308. Sidewall portion 306 includes at least one circumferential indent 310 and is located between upper portion 304 and bottom portion 308. Bottom portion 308 includes a base portion 312. In one embodiment, indents 310 are located in sidewall portion 306. Container body 302 defines a chamber (not shown) therein for containing fluids (e.g., liquid product such as waters, sports drinks, alcoholic beverages) and/or foods (e.g., sauces, such as apple sauce). Additionally, container body 302 includes a finish portion 314 extending from upper portion 304 and defining a mouth 316 in fluid communication with the chamber. Finish portion 314 can have a variety of configurations, and in the exemplary embodiment, includes a fastener or other engagement mechanism such as a flange 320. Flange 320 is for engaging a cap (not shown) or other closure member (not shown) of the container. These elements have an orientation and capping features as known in the art.

In the exemplary embodiment, sidewall portion 306 is formed with circumferential indents 310, which can also be referred to as grooves, rings, ribs, or beads. As shown in FIG. 10A, a plurality of indents 310 extend about an entire circumference of container 300, such circumference being relative to a particular diameter of any given section of container 300 where indents 310 are to be located. In the exemplary embodiment, a shape and width of container 300 varies from bottom to top as shown in FIG. 10A.

As illustrated in this embodiment, and as shown in FIGS. 10A and 10B, bottom portion 308 includes base portion 312 comprising a cylindrical base wall portion 322, a plurality of ribs 324, a plurality of voids 326, a support surface 328 defining a reference plane 342 (shown in FIG. 10C), and an inner core 330. Each rib 324 includes a bottom surface portion 332 which, in one embodiment, is substantially flat. Support surface 328 is comprised of bottom surface portions 332 of plurality of ribs 324. The combination of features 322, 324, 326, 328 and 330 and their respective structural/physical configurations enable base portion 312 to function as a variable dynamic base portion capable of moving in response to certain forces (e.g., pressure).

Support surface 328 is a surface derived from the plurality of bottom surface portions 332 of ribs 324, and the amount of surface area of support surface 328 depends on the number of ribs 324 and the surface area of bottom surface portions 332 that are aligned with reference plane 342. In one embodiment, bottom surface portions 332 extend perpendicularly to an axis 334 such that as bottom surface portions 332 extend toward central axis 334 they are parallel to reference plane 342. In an alternative embodiment, bottom surface portions extend at an angle such that as they extend toward axis 334, they extend away from upper portion 304.

As illustrated in FIG. 10B, plurality of ribs 324 and plurality of voids 326 of base portion 312 are arranged in a radial configuration around inner core 330. A variety of suitable configurations can be used for ribs 324 and voids 326 in accordance with the disclosed subject matter.

Figure 10C:
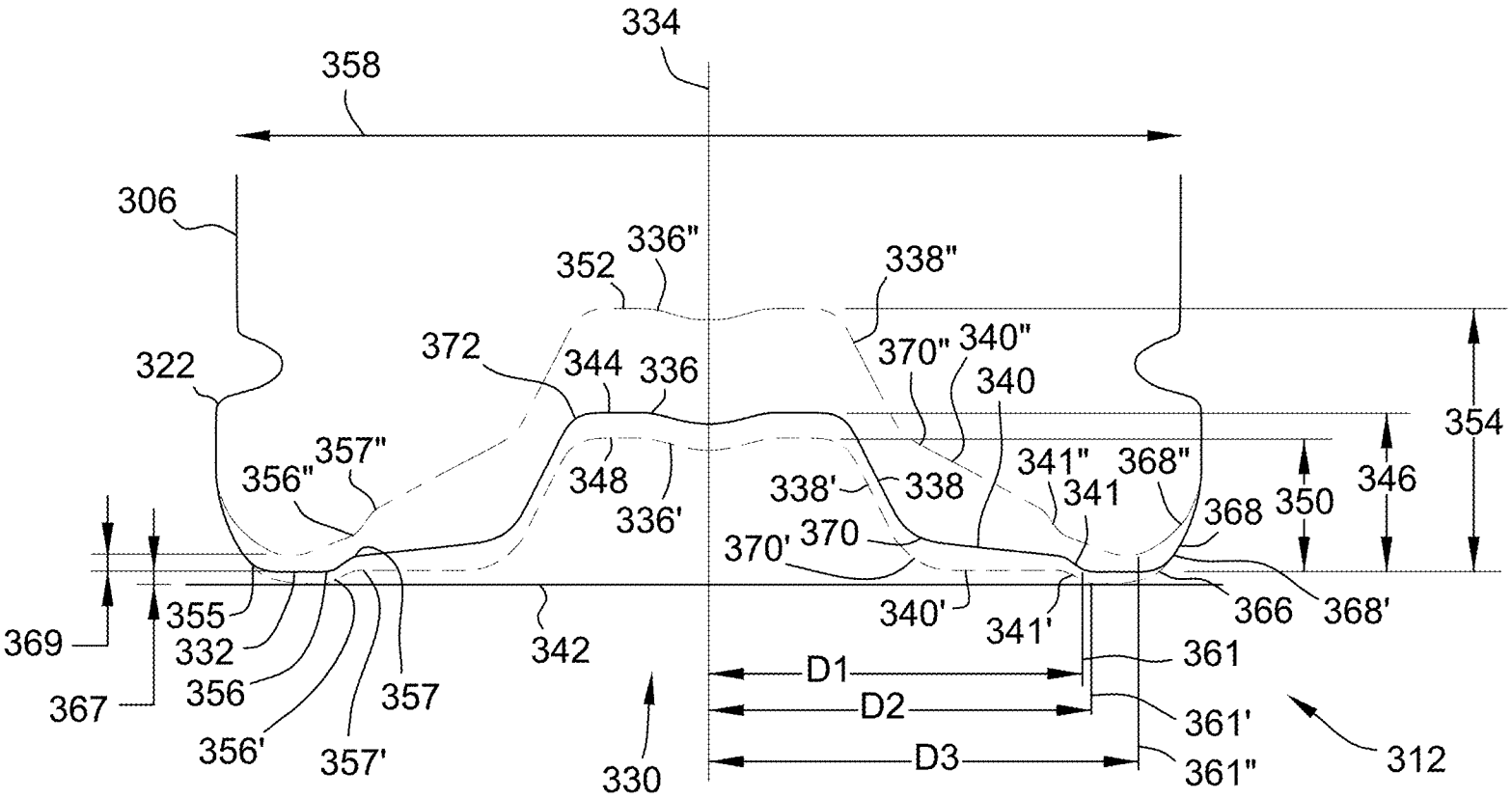
FIG. 10C is a cross-sectional detail view of the base of the container of FIG. 10A taken through the ribs of the base along line E-E of FIG. 10B, illustrating three positions of the base.
Figure 10D:
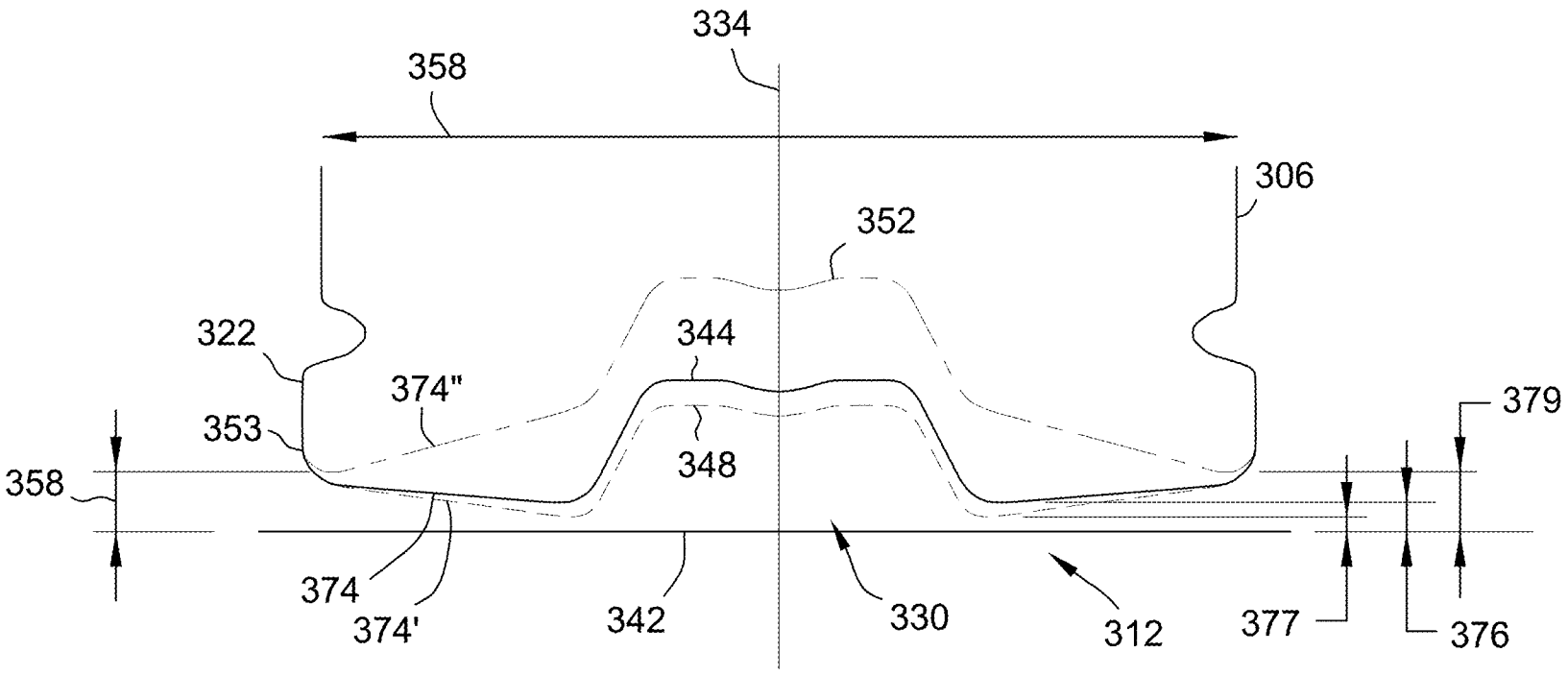
FIG. 10D is a cross-sectional detail view of the base of the container of FIG. 10A taken through the voids of the base along line F-F of FIG. 10B illustrating three positions of the base.

FIG. 10C is a cross-sectional detail view of base portion 312 taken through ribs 324 along line E-E of FIG. 10B. FIG. 10C illustrates three positions of base 312, a prefilled, or as molded, position, a filled and hot position, and a cooled and sealed position. FIG. 10D is a cross-sectional detail view of base 312 showing additional details with regard to the prefilled position. In the exemplary embodiment, base portion 312 is configured to be a variable dynamic base portion and is configured to move (e.g., deflect) in response to certain conditions, such as a pressure differential between the chamber and an exterior of container body 302. Base portion 312 may function as a diaphragm under certain pressure and/or temperature conditions and depending on the design parameters (dimensions, etc.) of the various elements of base portion 312.

As illustrated in FIGS. 10C and 10D, there are three configurations of inner core 330. A first position 344 is depicted by the solid line in FIG. 10C and represents a prefilled, or as molded, position in which container 300 has not yet been filled. Contoured wall portion 336 has a corresponding first height 346 in such first position 344. A second position 348 is depicted by the dotted line in FIG. 10C. Second position 348 represents a hot filled position in which container 300 has been filled with a hot fluid or food and has not yet cooled. With regard to second position 348, contoured wall portion 336' has a corresponding second height 350 in second position 348. In the exemplary embodiment, second height 350 is less than first height 346. A third position 352 is depicted by the dashed line in FIG. 10C. Third position 352 represents a sealed and cooled position in which container 300 has been filled with a hot fluid or food, sealed, and cooled. In third position 352, contoured wall portion 336" has a corresponding third height 354. In the exemplary embodiment, third height 354 is greater than each of first height 346 and second height 350. Element numbers that include a prime notation, "'" refer to elements in second position 348. Numbers that include a double prime notation "'" refer to elements in third position 352.

As shown in FIG. 10C, base portion 312 includes a curved corner 368 that extends from a bottom 353 of sidewall portion 306 to an outer edge 355 of bottom surface portion 332. As shown in FIG. 10C, base portion 312 is active, i.e. subject to movement, during the hot filling, sealing and cooling of container 300.

As further illustrated in FIG. 10C, base portion 312 includes a step portion 341 positioned between bottom surface portion 332 and second radiused portion 340. In accordance with this alternative embodiment, contoured wall portion 336, first radiused portion 338, second radiused portion 340, step portion 341, bottom surface portion 332 and a curved corner 368 are configured to move relative to other portions of container body 302, such as cylindrical base wall portion 322 and bottom surface portion 332. In the exemplary embodiment, as inner core 330 retracts deeper into container body 302 in third position 352 in response to sealing and cooling, third height 354 is greater than each of first height 346 and second height 350. In one embodiment, throughout this movement, container body 302 and base portion 312 maintain their desired circular shape. Additionally, in second position 348, second radiused portion 340' has a flatter profile compared to reference plane 342 than in first position 344 or third position and becomes substantially parallel to refence plane 342. After second radiused portion 340' has flattened out along reference plane 342 in second position 348, second radiused portion 340' remains a further distance from reference plane 342 than the distance of bottom surface portion 332' to reference plane 342. At third position 352, second radiused portion 340" and bottom surface portion 332" remain relatively flat and are inclined toward upper portion 304 as they extend toward axis 334.

As further illustrated in FIG. 10C, step portion 341 has an inclination start point at a hinge point 356 of base portion 312. Hinge point 356 delineates where step portion 341 starts to rise from bottom surface portion 332. Step portion 341 transitions to second contoured wall 340 at a second hinge point 357. In this embodiment, an active base region 358 spans between bottom 353 of sidewall portion 306 on one side of container 300 to bottom 353 of sidewall portion 306 on the opposite side of container 300 and comprises an entirety of base portion 312. Under certain pressure scenarios as disclosed herein, active base region 358 functions as a diaphragm and is configured to move downward along axis 334 in a direction away from upper portion 304 in response to being filled with a hot liquid or food and to move upward along axis 334 in a direction toward upper portion 304 in response to a decrease in internal pressure, such as the creation of an internal vacuum within container 300 due to cooling of the contents of container 300. In an alternative embodiment, active region 358 is configured to restrict or resist movement during hot filling and allows for less restricted movement in an opposite direction during cooling of the fluid after container 300 is sealed. Base portion 312 therefore provides improved sensitivity and controlled deformation from applied forces, for example resulting from pressurized filling, sterilization or pasteurization, and resulting thermal expansion due to hot liquid or food contents and/or vacuum deformation due to cooling of a hot liquid, or food, product filled therein. Base portion 312 can also influence controlled deformation from positive container pressure, for example resulting from expansion of liquid at increased temperatures or elevations.

As illustrated in FIG. 10C, base portion 312 comprises inner core 330 which has a generally dome structure and shape, and includes contoured wall portion 336, first radiused portion 338, and second hinge point 357. Active base region 358 and inner core 330 are configured to remain substantially in first position 344 when an interior pressure is within a first threshold range of values. The first threshold range of values includes an upper threshold value that can be any value required to displace active base region 358 from first position 344 toward second position 348.

As shown in FIG. 10C, step portion 341' and second hinge point 357' enable second contoured wall 340' to deflect away from upper portion 304 and still remain a distance way from reference plane 342. Additionally, curved corner 368 extends to cylindrical base wall portion 322. A first transition curve portion 370 extends between first radiused portion 338 and second radiused portion 340.

FIGS. 10C and 10D illustrate the variety of arcuate portions of inner core 330 and active base 358. For example, starting from cylindrical base wall portion 322, the following transitions are present: cylindrical base wall portion 322 transitions to curved corner 368; curved corner 368 transitions to flat bottom portion 332 at curve point 366; flat bottom portion 332 transitions to step portion 341 at hinge point 356; step portion 341 transitions to second radiused wall at second hinge point 357; second radiused wall portion 340 transitions to first radiused wall portion 338 at first transition curve portion 370; and first radiused wall portion 338 transitions to contoured wall portion 336 at second transition curve portion 372.

The dimensions and angles of the various features of base portion 312 can be selected to tailor the overall performance of base portion 312 as desired. For example, the radius and/or angle of curvature of first and second radiused portions 338 and 340, the distances therebetween, the thickness, and the lengths can be modified to increase or decrease the response of base portion 312 to pressure differentials to accommodate a range of thermodynamic environments, such as variations in hot-fill filling lines. Additionally, the amount of curvature of first and second radiused portions 338 and 340 and/or angle of curvature of these portions relative to a reference plane (e.g., 342) defined by support surface 328 can be selected for the desired response to pressure differentials to affect the efficiency of base portion 312 deformation. While not shown, any suitable variety of angular, height, and/or other dimensional relationships can be set for the various portions of base portion 312, including first and second radiused portions 338 and 340, hinge points 356 and 357, curve point 366, and other portions disclosed herein. While not shown in the figures, movement in active base region 358 can be split into sub-regions and depending on the particular design and characteristics of each of contoured wall portion 336, first radiused portion 338, second radiused portion 340, flat bottom portion 332 and curved corner 368, the amount of flex or deformation for each sub-region may vary.

In the exemplary embodiment, during a hot-filling process, the internal bottle pressure increases from an initial pressure to an elevated pressure when container 300 is filled with a hot liquid or food and then sealed. Active base region 358 is configured to react in a controlled manner, such that active base region 358 begins to move towards second position 348 when the internal pressure of container 300 exceeds the first threshold range upper value. As the internal pressure continues to increase beyond the first threshold range upper value, active base region 358 continues to move towards second position 348 until the internal pressure reaches a second threshold value at second position 348.

At second position 348, active base region 358 has moved in a direction opposite upper portion 304 along axis 334 except that only a small section of curved corner 368 which is closest to curve point 366 moves with the remainer of active base region 358. This movement causes base portion 312 to extend away from upper portion 304 a distance 367 such that a length of container 330, i.e., the distance from upper portion 304 top to an active base region point of contact 361' with planar surface 342 is increased by distance 367. The radius of curvature of first transition curve 370' increases causing a shallower inner core 330 at second position 348 compared to first position 344.

Additionally, active base region 358 is configured to move from second position 348 toward first position 344 as the internal pressure decreases below the second threshold value during a cooling process. As cooling continues and the pressure continues to decrease, inner core 330 continues to move toward first position 344 and then past first position 344. Once the liquid and bottle are completely cooled, the pressure inside container 300 reaches a third threshold value and active base region 358 reaches third position 352 and maintains third position 352 until container 300 is opened.

At third position 352, the entire active base region 358 has moved in a direction toward upper portion 304 along axis 334, including curved corner 368. This movement causes base portion 312 to draw inward along axis 334 toward upper portion 304 such that the active base region point of contact 361" with planar surface 342 has moved toward upper portion 304 a distance 369 compared to the active base point of contact 361 with planar surface 342 at first position 344. At third position 352, active base region 358 begins at sidewall portion bottom 353. Curved corner 368" moves inward toward axis 334 and upward toward upper portion 304 such that the radius of curvature of curved corner 368" has decreased. Bottom surface portion 332" has moved toward upper portion 304 and in a direction towards axis 334. At first position 344, container 300 contacts planar surface 342 along an entirety of support surface 328 and an inner most, i.e., closest to axis 334, contact point of container 300 is a distance D1 from axis 334. In an alternative embodiment, less than an entirety of support surface 328 contacts planar surface 342. At second position 348, container 300 contacts planar surface 342 along a portion of support surface 328' and at a point inside of support surface 328'. The point inside of support surface 328' is a distance D2 from axis 334. In this embodiment, D1 is less than D2. In an alternative embodiment, at second position 348, support surface 328' does not contact planar surface 342. At third position 352, support surface 328" is angled toward upper portion 304 in a direction towards axis 334. Support surface 328" contacts planar surface 342 at an outer region of support surface 328" at a distance D3 from axis 334. Distance D3 is greater than either D1 or D2.

As depicted in FIG. 10D, as active base region 358 moves downward along axis 334 in a direction away from upper portion 304 to second position 348, void upper surface 374 moves in a similar direction. In second position 348, the angle of inclination of void upper surface 374' is greater than in first position 344 since inner core 330 moves downward and has a height 377 of upper surface 374' from reference plane 342. Height 377 is less than height 376. In third position 352, the angle of inclination of void inner surface 374" reverses such that void inner surface 374" angles away from upper portion 304 as it extends from inner core 330 to base wall portion 322. Accordingly, a height 379 of void inner surface 374" from reference plane 342 adjacent inner core 330 is larger than a height 381 of upper surface 374" from reference plane 342 at a location where upper surface 374" approaches base wall portion 322.

Figure 10E:
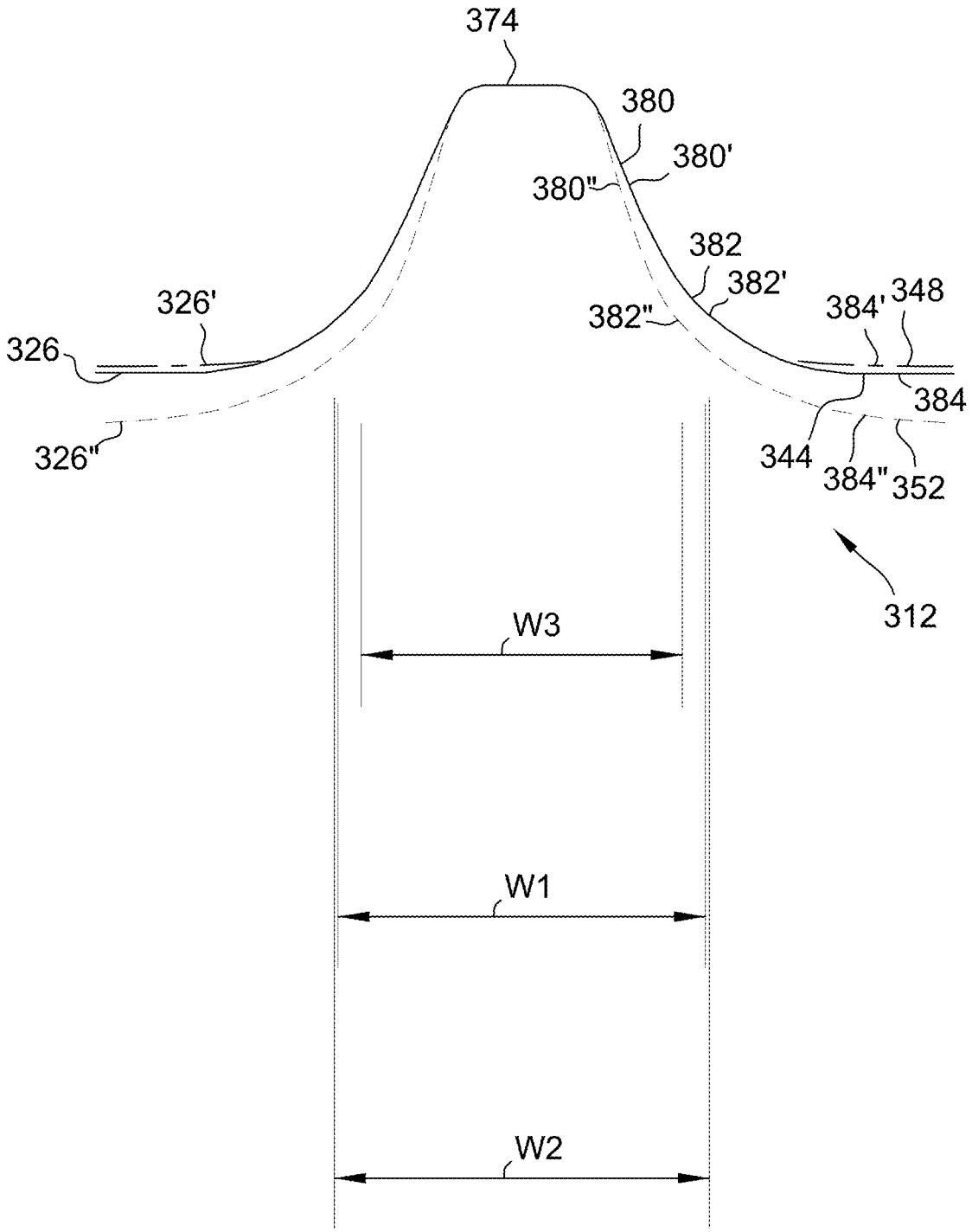
FIG. 10E is a cross-sectional detail view of the base of the container of FIG. 10A taken along line G-G of FIG. 10B.

FIG. 10E is a cross-sectional detail view of void, or strap, 326 of base portion 312 of container 300 of FIG. 10A taken along line G-G of FIG. 10B. FIG. 10C, as described above, illustrates three positions of base 312, a prefilled, or as molded, position, a filled and hot position, and a cooled and sealed position. As illustrated in FIG. 10E, there are three configurations of void 326. First position 344 is depicted by the solid line in FIG. 10E and represents a prefilled, or as molded, position in which container 300 has not yet been filled. Void 326 includes a first straight portion 380, a curved portion 382 and a second straight portion 384. Void 326 has a corresponding width W1 in such first position 344. Width W1 is the width at the intersection of an extension of first straight portion 380 and second straight portion 384. Second position 348 is depicted by the dotted line in FIG. 10E. Second position 348 represents a hot filled position in which container 300 has been filled with a hot fluid or food and has not yet cooled. With regard to second position 348, void 326' has a corresponding width W2. Width W2 is the width at the intersection of an extension of first straight portion 380' and second straight portion 384'. W2 is slightly greater than W1. A third position 352 is depicted by the dashed line in FIG. 10E. Third position 352 represents a sealed and cooled position in which container 300 has been filled with a hot fluid or food, sealed, and cooled. In third position 352, void 326" has a corresponding width W3. Width W3 is the width at the intersection of an extension of first straight portion 380" and second straight portion 384". In this embodiment, W3 is less than either W1 or W2.

As shown in FIG. 10E, voids 126, 226 and 326 provide stability to base portions 112, 212 and 312 as appreciated by the fact that the difference between W1 and W2 is minimal. Additionally, voids 126, 236 and 336 allow for substantial change of the width of voids 112, 212 and 312 from W2 to W3. This large change, as visible in FIG. 10E, enables voids 126, 226 and 326 to contribute to the movement of base portions 112, 212 and 312 as containers 100, 200 and 300 transition from second position 148', 248' and 348' to third position 148", 248" and 348".

Figure 11:
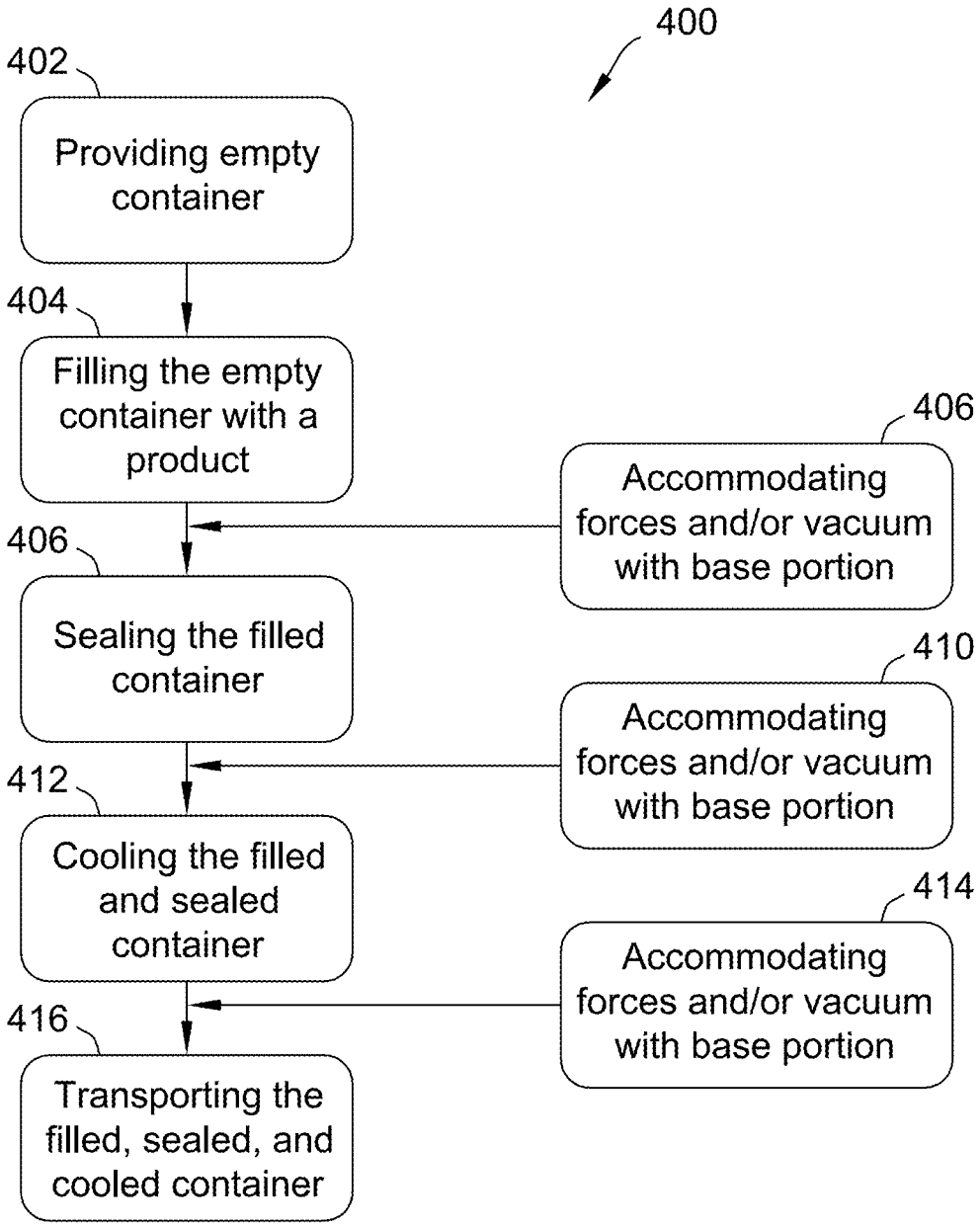
FIG. 11 is a flow chart of a method according to various embodiments of the disclosed subject matter.

FIG. 11 is a flow diagram for a method 400 according to embodiments disclosed herein. At step 4202, an empty container 100 (shown in FIG. 1) formed in a manner described herein is provided for filling. At step 404, empty container 100 is filled with a product. For example, the filling may comprise hot-filling container 100 with a hot liquid or a food, such as a sauce in a manner described herein. At step 406, filled container 100 accommodates forces via base portion 112 (shown in FIG. 1). Step 404 and/or step 406 may be referred to as a first fluid processing stage. At step 408, filled container 100 is sealed in a manner described herein. At step 410, similar to step 406, filled and sealed container 100 accommodates forces via base portion 112. Step 408 and/or step 410 may be referred to as a second fluid processing stage. At step 412, filled and sealed container 100 is cooled in a manner described herein. At step 414, similar to steps 406 and 410, filled, sealed, and cooled container 100 accommodates forces via base portion 112. Step 412 and/or step 414 may be referred to as a third fluid processing stage. For example, each of steps 406, 410, and 414 include base portion 112 accommodating pressure and/or temperature in a dynamic manner by moving/flexing in accordance with particular design features (e.g., ribs 124 (shown in FIG. 1), voids 126 (shown in FIG. 1), and the other portions) of base portion 112 as disclosed herein and the amount or degree of pressure and/or temperature present during the particular process stage. At step 416, filled, sealed, and cooled container 100 is transported. Such transportation may, without limitation, include (i) transporting to different production areas within a production facility, such as to allow for labeling or bulk packaging of container(s) 10, (ii) shipping of ready-for-sale container(s) 10, and (iii) transportation by consumers of purchased container(s) 10.

TABLE 1

Sample dimensions of features of container body 100.

| | Example (inch) | Range 1 (inch) | Range 2 (inch) |
|---|---|---|---|
| Height of inner core 130 | | | |
| First Position Height 146 | 0.570 | 0.420-0.750 | 0.350-1.000 |
| Second Position Height 150 | 0.462 | | |
| Third Position Height 154 | 0.779 | | |

TABLE 1-continued

Sample dimensions of features of container body 100.

| | Example (inch) | Range 1 (inch) | Range 2 (inch) |
|---|---|---|---|
| Width of contoured wall portion 136 | | | |
| First Position Width 162 | 0.725 | 0.550-1.200 | 0.350-1.500 |
| Width of support surface 128 | | | |
| First Position Width 164 | 0.180 | 0.100-0.300 | 0.050-0.500 |
| Radius to Support Surface Inner Contact Point | | | |
| First position radius D1 | 1.245 | 0.950-2.125 | 0.625-3.500 |
| Second position radius D2 | 1.236 | 0.900-2.075 | 0.620 3.400 |
| Third position radius D3 | 1.392 | 0.995-2.200 | 0.650-4.000 |
| Radius to Curved Corner Transition Point Along Ribs 124 | | | |
| First position D5 | 1.600 | 1.100-2.100 | 0.500-4.500 |
| Third position D4 | 1.565 | 1.095-2.050 | 0.450-4.450 |
| Radius to Curved Corner Transition Point Along Voids 126 | | | |
| First position D2 | 1.600 | 1.100-2.100 | 0.500-4.500 |
| Third position D1 | 1.587 | 1.095-2.050 | 0.450-4.450 |
| Movement of Contact Surface Relative to First Position | | | |
| Contact surface second position 157 | 0.043 | 0.020-0.100 | 0.010-0.300 |
| Contact Surface third position 159 | 0.032 | 0.016-0.094 | 0.005-0.270 |
| Angle of second radiused portion 140 | | | |
| First position angle 160 | 11°0' (e.g., 11°) | 5°0'-18°0' | 1°0'-25°0' (e.g., 1°-25°) |
| Void 126 | | | |
| First Width 182 | 0.074 | 0.045-0.225 | 0.025-0.350 |
| Second Width 184 | 0.238 | 0.185-0.345 | 0.100-0.450 |
| Height 186 | 0.176 | 0.095-0.235 | 0.050-0.350 |
| Width of Void 126 at intersection point | | | |
| First position W1 | 0.214 | 0.185-0.245 | 0.100-0.400 |
| Second position W2 | 0.218 | 0.190-0.250 | 0.105-0.395 |
| Third Position W3 | 0.185 | 0.150-0.225 | 0.080-0.350 |
| Deviation Of Support Surface 128 | | | |
| First Support Surface Deviation 176 | 0.161 | 0.095-0.225 | 0.050-0.300 |
| Second Support Surface Deviation 178 | 0.176 | 0.110-0.210 | 0.050-0.300 |
| Height of Void Upper Surface nearest Axis 134 | | | |
| First position height 176 | 0.065 | 0.040-0.180 | 0.025-0.340 |
| Second position height 177 | 0.161 | 0.110-0.295 | 0.090-0.400 |
| Third position height 179 | 0.221 | 0.150-0.340 | 0.100-0.450 |
| Height of Void Upper Surface nearest Basewall Portion 122 | | | |
| First position height 181 | 0.176 | 0.110-0.210 | 0.050-0.300 |

TABLE 2

Sample dimensions of features of container body 200.

| | Example (inch) | Range 1 (inch) | Range 2 (inch) |
|---|---|---|---|
| Height of inner core 130 | | | |
| First Position Height 246 | 0.599 | 0.400-0.850 | 0.350-1.000 |
| Second Position Height 250 | 0.480 | | |
| Third Position Height 254 | 0.749 | | |
| Radius to Support Surface Inner Contact Point | | | |
| Position 1 radius D1 | 0.991 | 0.750-2.230 | 0.500-3.200 |
| Position 2 radius D2 | 0.983 | 0.700-2.150 | 0.450 3.100 |
| Position 3 radius D3 | 1.121 | 0.900-2.250 | 0.600-4.000 |
| Movement of Contact Surface Relative to First Position | | | |
| Contact surface second position 257 | 0.032 | 0.016-0.96 | 0.010-0.300 |
| Contact Surface third position 259 | 0.045 | 0.018-0.100 | 0.005-0.270 |
| Lowest Point of Void Upper Surface | | | |
| First position height 276 | 0.083 | 0.040-0.180 | 0.025-0.325 |
| Second position height 277 | 0.030 | 0.015-0.085 | 0.010-0.190 |
| Third position height 279 | 0.158 | 0.095-0.340 | 0.050-0.750 |

TABLE 3

Sample dimensions of features of container body 300.

| | Example (inch) | Range 1 (inch) | Range 2 (inch) |
|---|---|---|---|
| Height of inner core 130 | | | |
| First Position Height 346 | 0.550 | 0.400-0.850 | 0.350-1.000 |
| Second Position Height 350 | 0.460 | | |
| Third Position Height 354 | 0.910 | | |
| Radius to Support Surface Inner Contact Point | | | |
| Position 1 radius D1 | 1.326 | 0.750-2.230 | 0.500-3.200 |
| Position 2 radius D2 | 1.340 | 0.700-2.150 | 0.450 3.100 |
| Position 3 radius D3 | 1.450 | 0.900-2.250 | 0.600-4.000 |
| Movement of Contact Surface Relative to First Position | | | |
| Contact surface second position 357 | 0.044 | 0.016-0.96 | 0.010-0.300 |
| Contact Surface third position 359 | 0.055 | 0.018-0.100 | 0.005-0.270 |
| Lowest Point of Void Upper Surface | | | |
| First position height 376 | 0.113 | 0.040-0.280 | 0.025-0.425 |
| Second position height 377 | 0.062 | 0.015-0.100 | 0.010-0.290 |
| Third position height 379 | 0.220 | 0.095-0.340 | 0.050-0.750 |

As disclosed herein, and for purpose of illustration and not limitation, containers 100, 200 and 300 can be formed using any suitable method as known in the art. For example, containers 100, 200 and 300 can be blow molded from an injection molded preform made from, for example, PET, PEN or blends thereof, or can be extrusion blow molded plastic, for example, polypropylene (PP). Thread 118 and flange 120, 220 and 320 of containers 100, 200 and 300 respectively, can be injection molded, i.e., the thread 118 can be formed as part of the preform, or can be blow molded and severed from an accommodation feature formed above, as is known in the art. The preform can be blown into a mold/die comprising certain structural features to arrive at the desired container shape and properties. The mold/die may be formed to include structural features that correspond to those present in the blown containers 100, 200 and 300.

The methods, systems, and compositions disclosed herein are not limited to the specific embodiments described herein, but rather, steps of the methods, elements of the systems, and/or elements of the compositions may be utilized independently and separately from other steps and/or elements described herein Rather, the methods, systems, and compositions may be implemented and utilized in connection with many other applications.

Although specific features of various embodiments may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

This written description uses examples, including the best mode, to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A plastic container comprising:

a container body comprising a bottom portion, an upper portion, a sidewall portion extending between said upper portion and said bottom portion, and a finish portion, said container body having a chamber defined therein, said finish portion extending from said upper portion and defining a mouth in fluid communication with said chamber;

said bottom portion including a base portion comprising:

a support surface;

a plurality of ribs;

a plurality of voids; and, an inner core aligned with a central axis of said container body, said inner core including a contoured wall portion, a first radiused wall portion adjacent said contoured wall portion, and a second radiused wall portion adjacent said first radiused wall portion;

wherein said plurality of ribs and said plurality of voids are arranged radially relative to said inner core; and, wherein, in response to an increase in internal pressure differential after filling with a heated liquid and capping, said bottom portion is configured to permit a region of said support surface to move downwardly and wherein said support surface is angled upwards and extends towards said upper portion as it extends away from said inner core and towards said sidewall portion.

2. The plastic container of claim 1, wherein said bottom portion comprises a curved corner between said support surface and said sidewall, said bottom portion being further configured to move in response to a varying pressure differential comprising:

a first pressure differential present during a first heated fluid processing stage of said container body;

a second pressure differential present during a second heated fluid processing stage of said container body, said second pressure differential being different than said first pressure differential, and said second heated fluid processing stage being different than said first heated fluid processing stage;

a third pressure differential present during a third cooled fluid processing stage of said container body, said third pressure differential being different than each of said first pressure differential and said second pressure differential, and said third cooled fluid processing stage being different than each of said first heated fluid processing stage and said second heated fluid processing stage, and, wherein said contoured wall portion is configured to move from a first height from the support surface in said first pressure differential to a second height in response to said second pressure differential, said second height being less than said first height, and to a third height in response to said third pressure differential, said third height being different than each of said first height and said second height.

3. The plastic container of claim 2, wherein said third height is greater than each of said first height and said second height, and wherein said curved corner is configured to move inward towards said central axis and upward towards said upper portion in said third pressure differential and a radius of curvature within said curved corner decreases.

4. The plastic container of claim 2, wherein said support surface extends towards said upper portion as it extends away from said inner core during the first heated fluid processing stage and said support surface extends towards said upper portion as it extends towards said inner core and away from said sidewall during said third cooled fluid processing stage.

5. The plastic container of claim 1, wherein each rib of said plurality of ribs includes a bottom surface portion having a surface area, said support surface comprising a surface area defined by a cumulative surface area of each said surface area of each said bottom surface portion.

6. The plastic container of claim 1, wherein a number of said plurality of ribs is 16 or greater.

7. The plastic container of claim 1, wherein a number of said plurality of ribs is equal to a number of said plurality of voids.

8. The plastic container of claim 1, wherein each of said plurality of voids has a tapered configuration comprising an upper surface and a lower gap portion, wherein a width of said lower gap portion is greater than a width of said upper surface.

9. The plastic container of claim 1, wherein each of said plurality of voids has a same height relative to said support surface.

10. The plastic container of claim 1, wherein said base portion further comprises a cylindrical base wall portion, said support surface being between said cylindrical base wall portion and said second radiused wall portion.

11. The plastic container of claim 1, wherein said first radiused wall portion has an angled configuration and said second radiused wall portion has an angled configuration, and wherein an angle of said first radiused wall portion angled configuration is greater than an angle of said second radiused wall portion angled configuration.

12. The plastic container of claim 11, wherein said angle of said second radiused wall portion angled configuration has a value within a range of 1° to 25°.

13. The plastic container of claim 1, wherein said support surface extends upwardly between about 0.5° and 10.0°.

14. The plastic container of claim 13, wherein said support surface extends upwardly between about 2° and 7.0°.

15. The plastic container of claim 1, wherein said base portion further comprises a step portion between a first hinge point adjacent said support surface and a second hinge.

16. The plastic container of claim 15, wherein during said second heated fluid processing stage, said second radiused wall portion remains a distance from a reference plane defined by said support surface.

17. A plastic container comprising:

a container body comprising a bottom portion, an upper portion, a sidewall portion extending between said upper portion and said bottom portion, and a finish portion, said container body having a chamber defined therein, said finish portion extends from said upper portion and defines a mouth in fluid communication with said chamber;

said bottom portion including a base portion comprising:

a support surface;

a plurality of ribs;

a plurality of voids; and, an inner core aligned with a central axis of said container body, said inner core including a contoured wall portion, a first radiused wall portion adjacent said contoured wall portion, and a second radiused wall portion adjacent said first radiused wall portion;

wherein said base portion further comprises a step portion between a first hinge point adjacent the support surface and a second hinge point;

wherein said plurality of ribs and said plurality of voids are arranged radially relative to said inner core; and, wherein said bottom portion is configured to permit said support surface to move downwardly and away from said upper portion in response to an increase in internal pressure differential after filling with a heated fluid and capping, and upwardly and closer to said upper portion in response to a decrease in internal pressure differential after cooling the heated fluid.

18. The container of claim 17, wherein during the increased internal pressure differential the second radiused wall portion remains a distance from a reference plane defined by the support surface.

19. The container of claim 17, wherein the support surface, in an as molded position, extends towards said upper portion as it extends away from said inner core and has a contact point at a distance D1 from said central axis, and further wherein, during the decreased internal pressure differential, the support surface extends towards said upper portion as it extends towards said inner core and has a contact point at a distance D3 from said central axis with said distance D3 greater than said distance D1.

20. A plastic container comprising:

a container body comprising a bottom portion, an upper portion, a sidewall portion extending between said upper portion and said bottom portion, and a finish portion, said container body having a chamber defined therein, said finish portion extends from said upper portion and defines a mouth in fluid communication with said chamber;

said bottom portion including a base portion comprising:

a support surface;

a plurality of ribs;

a plurality of voids; and, an inner core aligned with a central axis of said container body, said inner core including a contoured wall portion, a first radiused wall portion adjacent said contoured wall portion, and a second radiused wall portion adjacent said first radiused wall portion;

wherein the support surface extends towards said upper portion as it extends away from said inner core and a point of the support surface closest to the central axis is at a distance D1;

wherein said base portion further comprises a step portion between a first hinge point adjacent the support surface and a second hinge point;

wherein said plurality of ribs and said plurality of voids are arranged radially relative to said inner core;

wherein said bottom portion is configured to permit a region of the support surface to move downwardly in response to an increase in internal pressure differential after filling with a heated fluid and capping, and upwardly in response to a decrease in internal pressure differential after cooling the heated fluid;

wherein, during the increased internal pressure differential, the second radiused wall portion remains at a distance from a reference plane defined by the support surface; and, wherein, during the decreased internal pressure differential, the support surface extends towards said upper portion as it extends towards said inner core and has the point of the support surface closest to the central axis is at a distance D3 with distance D3 being greater than distance D1.

* * * * *